United States Patent [19]

Roberts

[11] 4,186,636

[45] Feb. 5, 1980

[54] DIGITAL CHORD GENERATION FOR ELECTRONIC MUSICAL INSTRUMENTS

[75] Inventor: Patrick S. Roberts, Rolling Meadows, Ill.

[73] Assignee: Thomas International Corporation, Chicago, Ill.

[21] Appl. No.: 834,686

[22] Filed: Sep. 19, 1977

Related U.S. Application Data

[63] Continuation of Ser. No. 624,416, Oct. 21, 1975, abandoned, which is a continuation-in-part of Ser. No. 603,859, Aug. 11, 1975, Pat. No. 4,046,047.

[51] Int. Cl.[2] ..... G10H 1/00

[52] U.S. Cl. ..... 84/1.01; 84/1.03; 84/1.17; 84/1.24; 84/DIG. 22

[58] Field of Search ..... 84/1.01, 1.03, 1.17, 84/1.24, DIG. 22

[56] References Cited

U.S. PATENT DOCUMENTS

| | | | |
|---|---|---|---|
| 3,544,693 | 12/1970 | Tripp | 84/1.01 |
| 3,546,355 | 12/1970 | Maynard | 84/1.03 |
| 3,548,066 | 12/1970 | Freeman | 84/1.03 |
| 3,610,801 | 10/1971 | Fredkie | 84/1.03 |
| 3,639,913 | 2/1972 | Watson | 84/1.01 |
| 3,697,661 | 10/1972 | Deutsch | 84/1.01 |
| 3,715,442 | 2/1973 | Freeman | 84/1.01 |
| 3,740,450 | 6/1973 | Deutsch | 84/1.24 |
| 3,789,718 | 2/1974 | Bunger | 84/1.01 |
| 3,795,755 | 3/1974 | Uchiyama | 84/1.03 |
| 3,839,592 | 10/1974 | Freeman | 84/1.01 |
| 3,844,192 | 10/1974 | Brand et al. | 84/1.01 |
| 3,871,262 | 3/1974 | Robinson et al. | 84/1.17 |
| 3,889,568 | 6/1975 | Amaya | 84/1.01 |
| 3,908,502 | 9/1975 | Kidd et al. | 84/1.01 |
| 3,929,051 | 12/1975 | Moore | 84/1.17 |
| 3,990,339 | 11/1976 | Robinson et al. | 84/1.17 |

*Primary Examiner*—Ulysses Weldon

*Attorney, Agent, or Firm*—Wegner, Stellman, McCord, Wiles & Wood

[57] ABSTRACT

An electrical musical instrument having a digital circuit which automatically generates selected chordally related tone signals in response to manual selection of a root note. A root encoder provides a binary code representative of the root note in response to note selections, and an interval code generator automatically provides code signals having binary number values equal to the number of half steps from the root for a given interval. An adder arithmetically adds the root code and the interval code to generate a code for a chordally related note having both octave and note information corresponding to the automatically generated tone signal. In one mode of operation, the root code represents the root of the root-fifth pair of highest priority around the circle of fifths selected on a manual keyboard. In another mode, the root code is representative of a note selected on the pedal clavier.

21 Claims, 14 Drawing Figures

FROM AUTO CODE GENERATOR 108
AUTO FUNCTION SELECTION CKT 34

A
B
C
D
E
F
G
ROOT
FIFTH
IE-4
IE-5
132
128
126
134
110
WB
FFO
FFI
ARP
STR
AP
AM
RY
PL/H
124
MANUAL FUNCTION SELECTION CKT 36
I-1
I-2
I-3
I-4
I-5
I-6
I-7
I-8
I-9
I-10
I-11
I-12

162
720
804
806
796
798
800
802
829
828
824
826
854
856
816
808
858
860
818
810
820
812
822
814
836
746
748
756
726
RA
RB
RC
RD
SC
RF
MC
AP
IE-6'
ME-1
RF·AP
PE
CS
IE-3
D13
IE-6'

DIGITAL CHORD GENERATION FOR ELECTRONIC MUSICAL INSTRUMENTS

CROSS-REFERENCE

This application is a continuation of my copending application Ser. No. 624,416, filed Oct. 21, 1975, entitled "Digital Chord Generator for Electronic Musical Instruments" now abandoned, which in turn is a continuation-in-part of my copending application Ser. No. 603,859 filed Aug. 11, 1975, entitled "Note Selection Circuit for Electronic Musical Instrument" now U.S. Pat. No. 4,046,047, both assigned to the assignee of this application.

BACKGROUND OF THE INVENTION

This invention relates to an electrical musical instrument having a circuit for automatically playing notes chordally related to a manually selected root note.

The relatively recent popularity of electrical musical instruments, such as electronic organs, is due in great part to automatic features thereof which enable an inexperienced organist to achieve musical effects which could not otherwise be achieved. One such musical effect that inexperienced organists find difficult to perform is a walking bass effect. In the walking bass effect, bass notes chordally related to a root note of a chord selected on an accompaniment keyboard are rhythmically played on the pedal clavier. Alternately, a walking bass effect is achieved by rhythmically playing notes chordally related to a root note selected on the pedal clavier, when no note selections are being made on the accompaniment manual.

Circuits for automatically achieving these effects are known. In U.S. Pat. No. 3,548,066 issued Dec. 15, 1970, to Freeman, a circuit is shown having one mode of operation in which the root and fifth parts of a chord selected on the accompaniment manual are automatically rhythmically sounded in the bass. In another mode of operation, the root and fifth parts are sounded in the bass in response to root note selections on the pedal clavier. The Freeman circuit achieves this result through inhibiting and enabling circuit links for controlling various keyers associated with the bass notes, and is limited to sounding only the root and fifth parts. Other parts of the chord, such as the third, seventh, etc., cannot be automatically generated.

Another approach to automatic generation of the notes of a chord is shown in the co-pending U.S. application of Carlson Ser. No. 482,064 filed June 24, 1974, now U.S. Pat. No. 4,019,417, issued April 26, 1977, and assigned to the assignee of the present invention. There, all the tone signals of a selected chord are generated in response to detection of a root note selected on the keyboard. The generated tone signals are provided to a sequential gating circuit which sequentially gates, one at a time, selected ones of the generated tone signals to voicing circuitry.

In U.S. Pat No. 3,544,693 issued Dec. 1, 1970, to Tripp, a pedal root tone is selected and all of the tones of the chord of that root are developed in response thereto. Selected ones of the provided tones are then sounded in accordance with a separate selection of the type of chord to be played.

A different approach to automatic note generation is shown in the U.S. Pat. No. 3,610,801 issued Oct. 5, 1971 to Fredkin. A digital musical synthesizer is shown there in which digital note information is stored in a shift register 15 and periodically changed through digital feedback signals from different points in the register itself to thereby successively provide information representative of different notes.

SUMMARY OF THE INVENTION

In accordance with the digital chord generation circuit of the present invention, a walking bass effect is provided through digital encoding and decoding techniques that enable a simpler yet more versatile operation than heretofore known. The effect is achieved by developing a note code representative of the root of a chord, providing a code representative of a selected chord interval and, in response to both the root code and the interval code, generating a note code for a chordally related note which is removed from the root note by the selected interval. A tone signal corresponding to the note code is generated through operation of a suitable tone selector circuit.

Advantages over the prior art are achieved. Unlike the system of Freeman, the digital chord generation circuit is not limited to generating only the root and fifth parts of a chord. Rather, any part of a given chord may be generated by simply providing the appropriate interval code therefor. Unlike the circuit of Tripp, the complications of circuitry for providing all of the possible tone signals of a chord of a given root are eliminated. Only the tone signal corresponding to the selected interval of the selected root is generated. In fact, the tone selector circuit may serve conventional note selection circuitry in addition to the automatic chord generation circuit. A positive control through operation of the keyboard is achieved that is not obtained by the musical synthesizer of Fredkin.

Preferably, the chord note code is generated by arithmetically adding the binary code number representation of the root note with the binary number representation of the number of half steps corresponding to the selected interval. A modified modulo 12 adder generates a five-bit code and assigns the fifth and most significant bit the value of twelve rather than the customary value of sixteen. A 1-state signal in the fifth bit location thereby indicates that the selected chord note is in a higher octave than the root note. The note, code without reference to octave, is located in the four least significant bit locations. The five-bit chord note code thereby carries both note and octave information.

Several modes of operation are provided. In one mode of operation, the auto pedal mode, the root note code is the root of the highest priority detected root-fifth pair of manual keyboard notes selected around the circle of fifths. When a valid root-fifth pair is detected, an interval signal encoder is enabled to provide the requisite interval information to the adder. If a valid root-fifth pair is not detected, the interval signal encoder is disabled and the root is taken as the lowest selected keyboard note. With the interval signal encoder disabled, this lowest note played in the keyboard octave is simultaneously played in the bass without alteration. In a non-auto pedal mode of operation, the root code is generated in response to selections from the pedal clavier, and the interval signal encoder is enabled to alter the chord note code generated by the adder. The generated chordally related notes are therefore played, one at a time, in walking bass fashion. Alternatively a fifth note can be generated in another mode to provide root and fifth note playing in selected rhythm patterns.

In the illustrative embodiment, chord note codes corresponding to the 3rd, 4th, 5th, 6th, 7th and 8th intervals are successively and rhythmically generated. Because of the coding system, the circuit can be easily adapted to respond to a greater or lesser number of interval signals. It should be understood that the invention can be used to generate many different musical effects. With the described method and circuit any note can be generated from a selected root note by encoding the root note, algebraically adding an interval code thereto, and decoding the result. In the illustrated embodiment the generated notes are used to automatically generate walking bass effects and root-fifth effects. However, the invention can also be used to generate chords, harmony and any other musical effects where an automatically produced tone signal is related to a selected tone signal.

Other advantageous features of the invention will be apparent from the following description and from the drawings. While illustrative embodiments of the invention are shown in the drawings and will be described in detail therein, the invention is susceptible of embodiment in many different forms, and it should be understood that the present disclosure is to be considered as an exemplification of the principles of the invention and is not intended to limit the invention to the embodiments illustrated.

FIGS. *3a, 3b, 3c* and *3d* are the composite parts of a single block diagram taken from and illustrating the electrical musical instrument of my aforementioned co-pending application in which the preferred embodiment of the present invention is employed;

FIG. 4 is a comparative timing diagram of various signals developed in the electrical musical instrument of FIGS. *3a–3d;*

Figure 5:
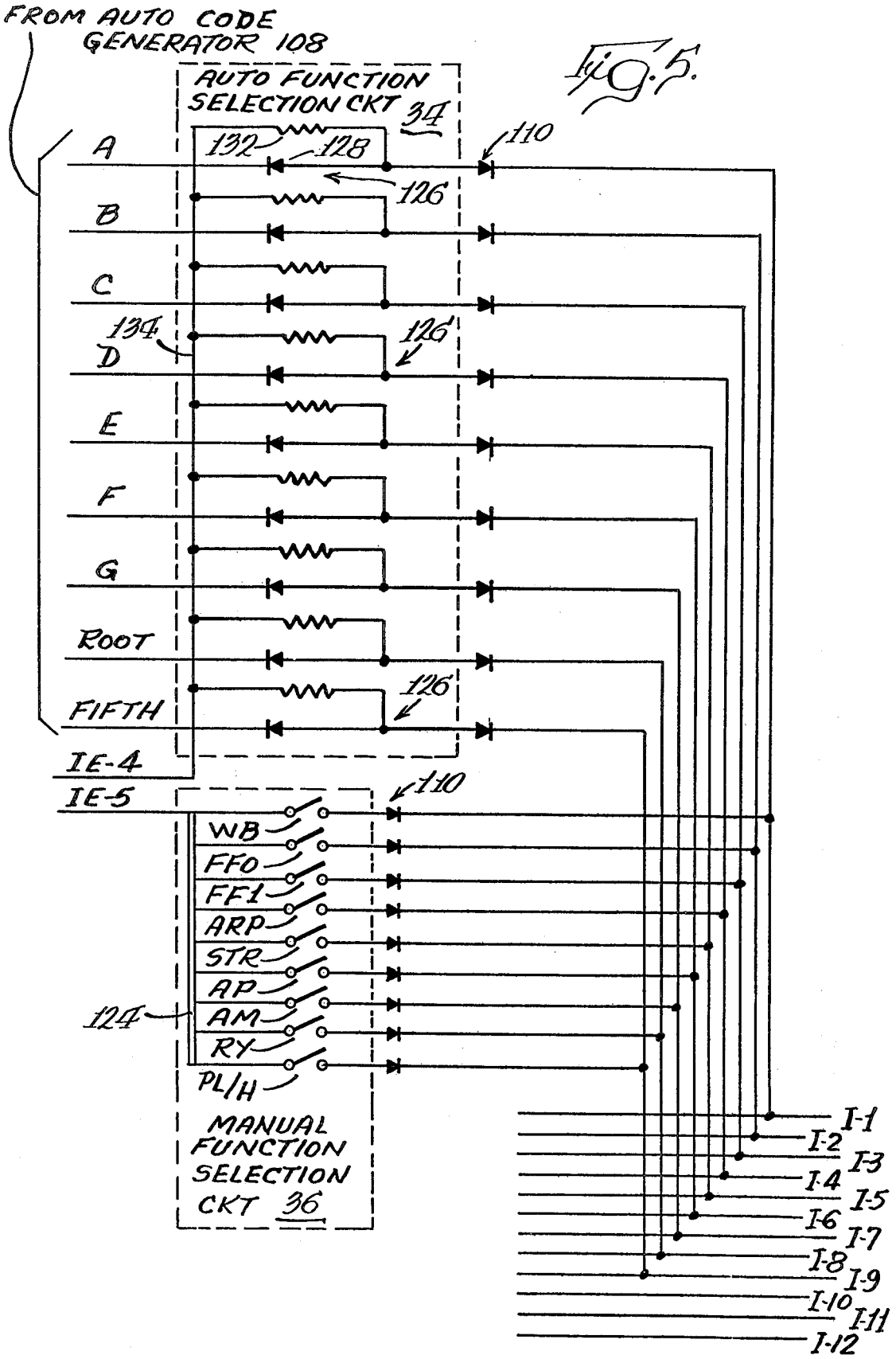

FIG. 5 is a schematic diagram of circuitry corresponding to the auto function selection circuit and manual function selection circuit blocks of FIG. *3a;*

Figure 1:
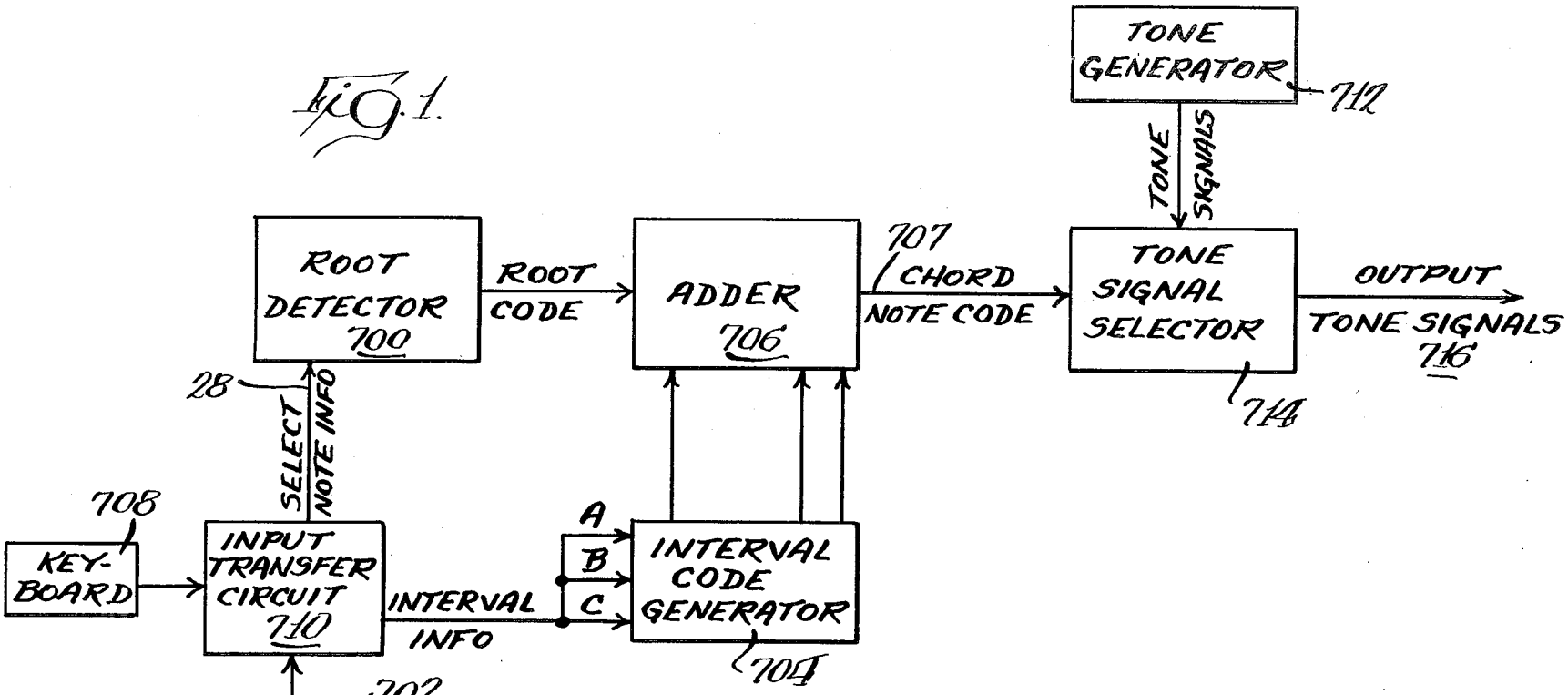
FIG. 1 is a simplified, functional block diagram of the digital chord generation circuit.
Figure 2:
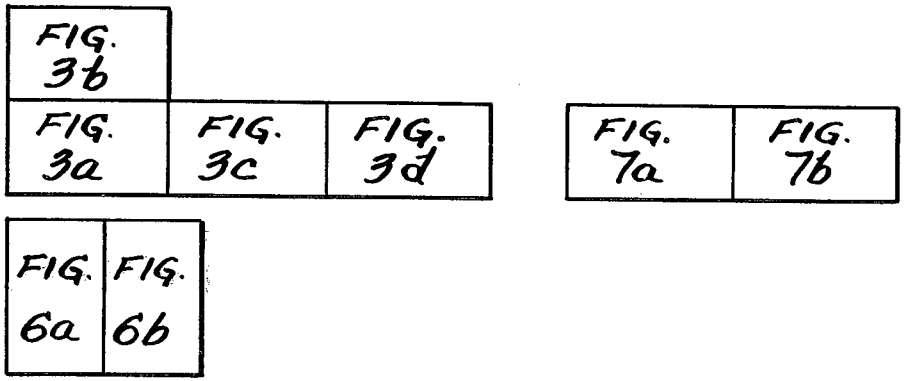
FIG. 2 is an illustration of the manner in which some of the subsequent figures of the drawings may be arranged into groups with each group comprising a single continuous line schematic.

FIGS. *6a* and *6b* are the parts of another block diagram of the digital chord generation circuit corresponding to, but having more detail than, the block diagram of FIG. 1, and illustrating the relationship thereof with the circuitry of the musical instrument shown in FIGS. *3a–3d,* particularly the pedal note latch circuit 162, the pedal note code select circuit 180 and the function latch circuits 240 and 242;

FIGS. *7a* and *7b* are the composite parts of a schematic diagram for circuitry corresponding to the various functional blocks of FIG. *6a;*

Figure 8:
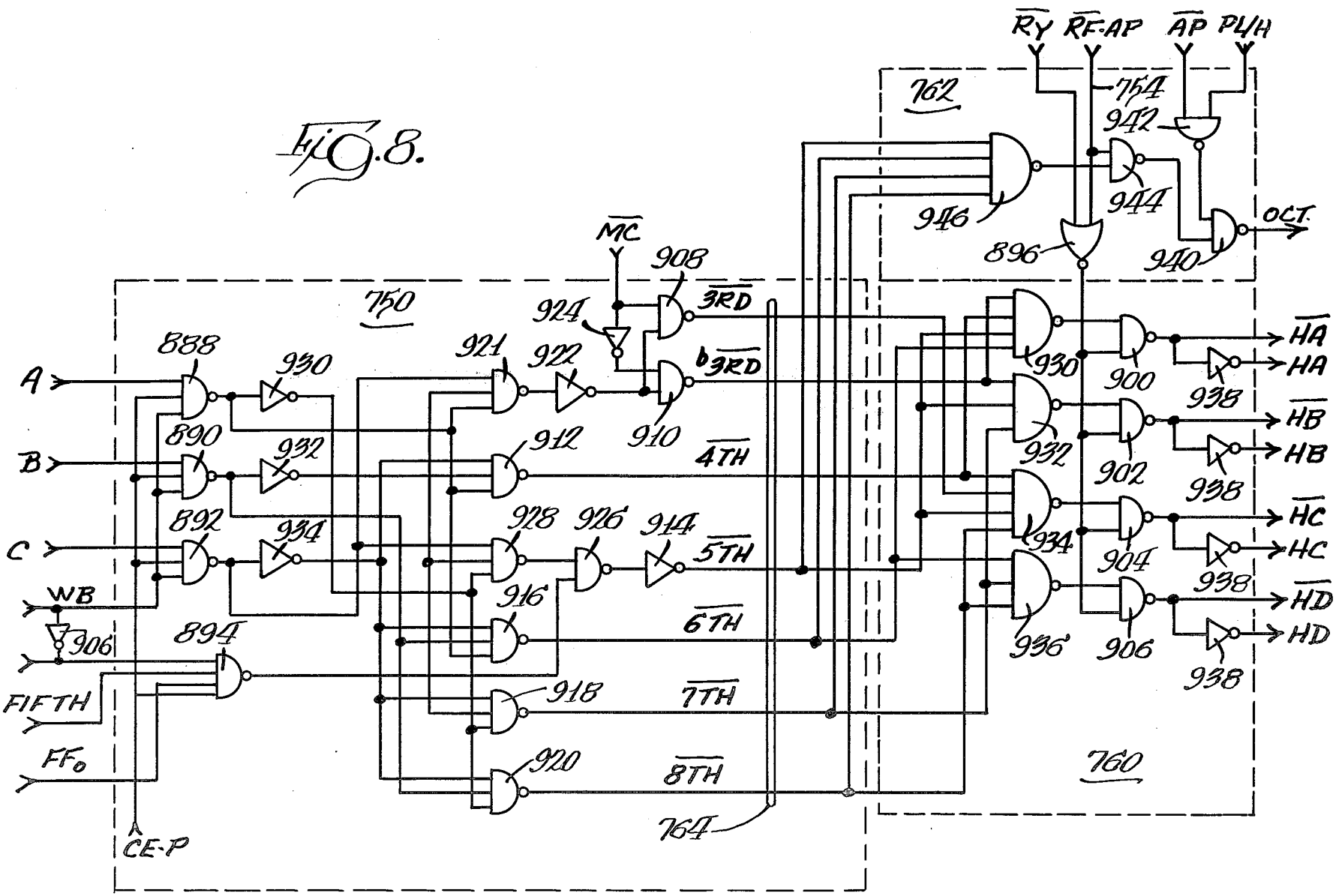
Figure 9:
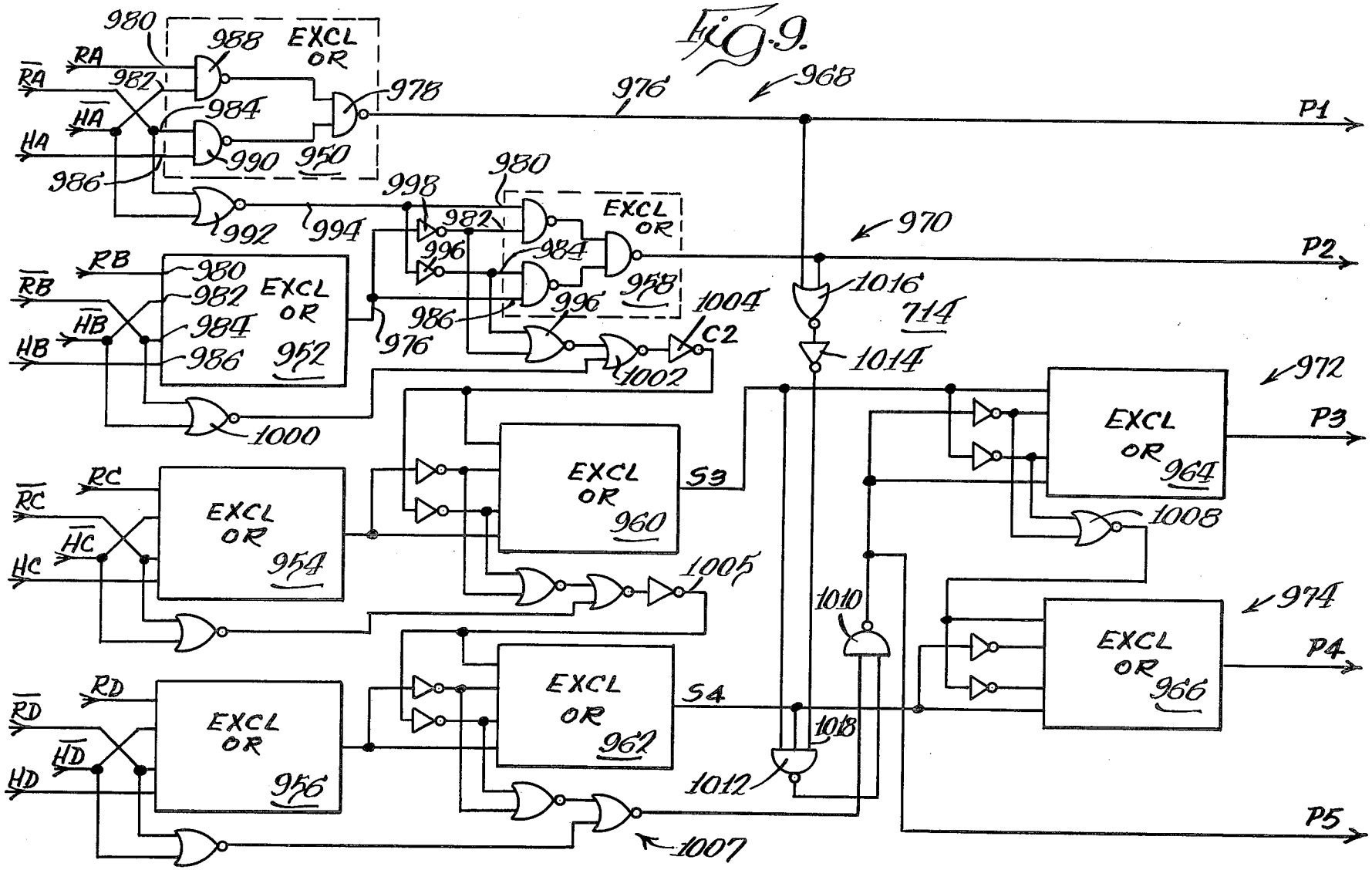

FIG. 8 is a schematic diagram of circuitry corresponding to the interval signal decoder, half-step number decoder, and octave decoder functional blocks of FIG. *6b;* and FIG. 9 is a schematic diagram of circuitry corresponding to the adder functional block of FIG. *6b.*

DESCRIPTION OF THE PREFERRED EMBODIMENT

I. Introduction

The chord generation circuit functions to generate output tone signals corresponding to the constituent interval notes of a chord (e.g., root, third, fourth, etc.) in accordance with operator selected notes, function information and interval information. This is achieved by providing a binary code for the root note identifying the chord, generating a code representing the number of half steps corresponding to the desired interval, encoding the provided interval information and arithmetically adding the binary codes for the root and the number of half steps to generate a new code representative of the selected note. The tone signal selector generates an output tone signal in accordance with the note code.

The tones so generated can be used for a number of musical effects. In the illustrated embodiment the selected note is arrived at by scanning the notes played on the lower manual and determining if any of the played notes are related as root and fifth. The lowest frequence detected pair of notes which has this relationship is selected and the root note thereof is used as the selected root note.

The selected note is arrived at by advancing around the musical scale from the root by the number of indicated half steps. The number of half steps from the chord root of the flatted third (♭3*d*), third, fourth, fifth, sixth, minor seventh (hereinafter referred to as seventh) and eighth is three, four, five seven, nine, ten and twelve. Thus, with the note C being the root note and the fifth interval being indicated, the selected chord note G is arrived at by counting seven half steps through notes C♯, D, D♯, E, F, F♯ and G. Likewise, for example, with the root G and the seventh interval being indicated, the selected chord note F is arrived at by counting ten half steps through G♯, A, A♯, and B at the end of the scale, and then continuing to count through notes C and F from the beginning of the scale.

As seen in the simplified functional block diagram of FIG. 1, the digital chord generation circuit includes four functional elements: a root detector 700, an interval signal source 702, an interval code generator 704, and an adder 706. The elements of the chord generation circuit are employed in conjunction with the circuitry of an electrical musical instrument including a keyboard/function circuit 708, an input transfer circuit 710, a tone signal generator 712, and a tone signal selector 714.

The notes are selected by pressing down associated keys of the keyboard 708. This selected note information is transferred to root detector 700 through an input transfer circuit 710. The root detector 700 in response to the selected note information detects when two of the selected notes are related as a root and a fifth around the circle of fifths and generates a binary code representing the root note. For example, if notes F and A♯ are selected, the binary code for note A♯ is generated. Likewise, for example, if notes F and C are selected, the code for note F is generated. The root code is then applied to adder 706.

The interval information is provided by interval signal source 702 as interval signals. The interval signals are transferred through input transfer circuit 710 to interval code generator 704. The interval code generator 704, in response to each interval signal generates a binary code representing the number of half steps associated therewith. The half step code is also applied to adder 706.

Adder 706 arithmetically adds the root code and the interval code to generate the code for the selected chord note on its chord note information output 707. The chord note code contains octave information in addition to note information. The tone signal selector 714 responds to the note information of chord note code to select an appropriate one of twelve tone signals from tone signal generator 712 and responds to the octave information to select an octave therefor. An output tone signal is generated on its output 716 having the frequency of the selected tone signal or a frequency octavely related thereto.

II. Organization

Figure 3A:
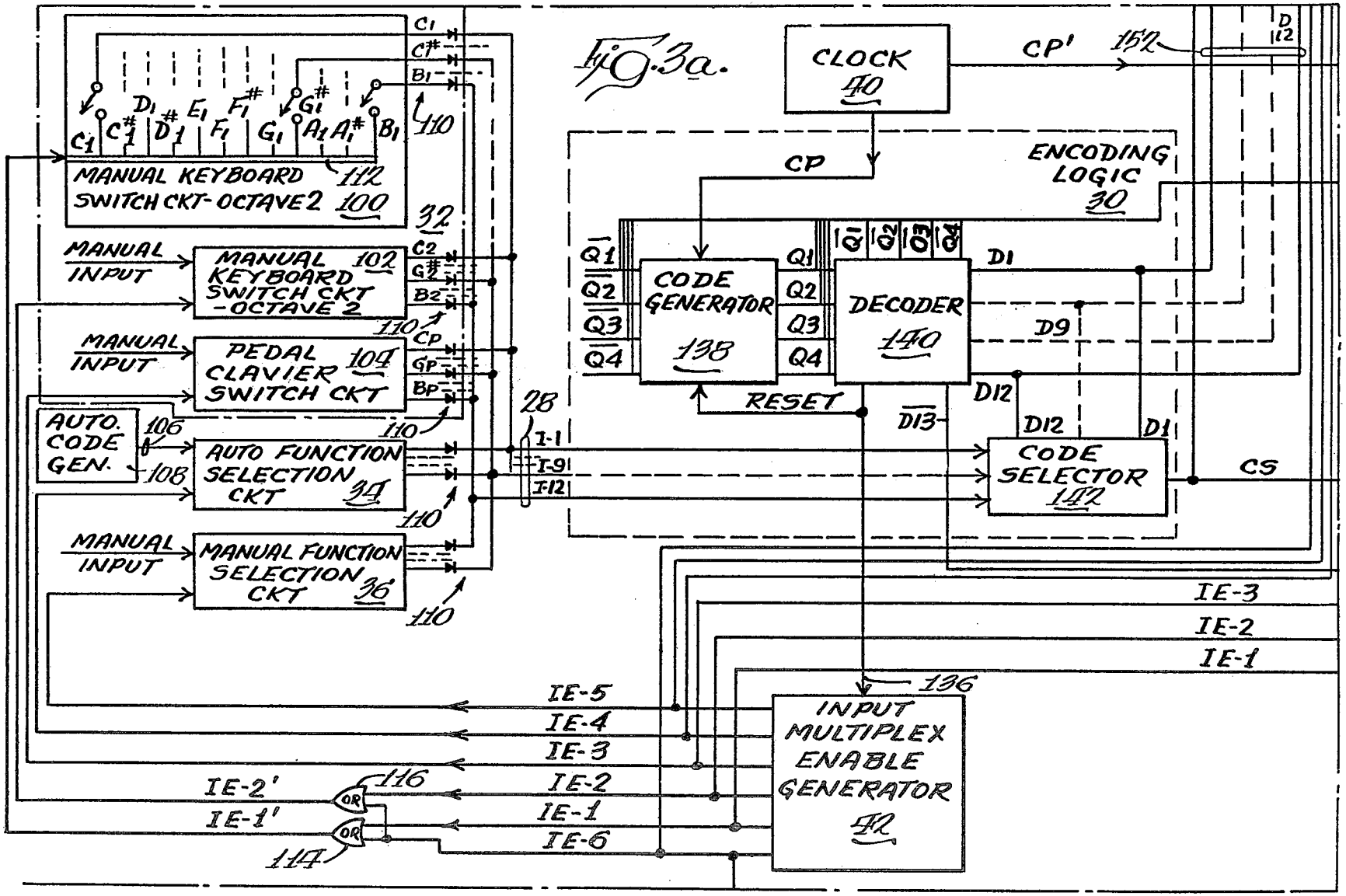
Figure 3B:
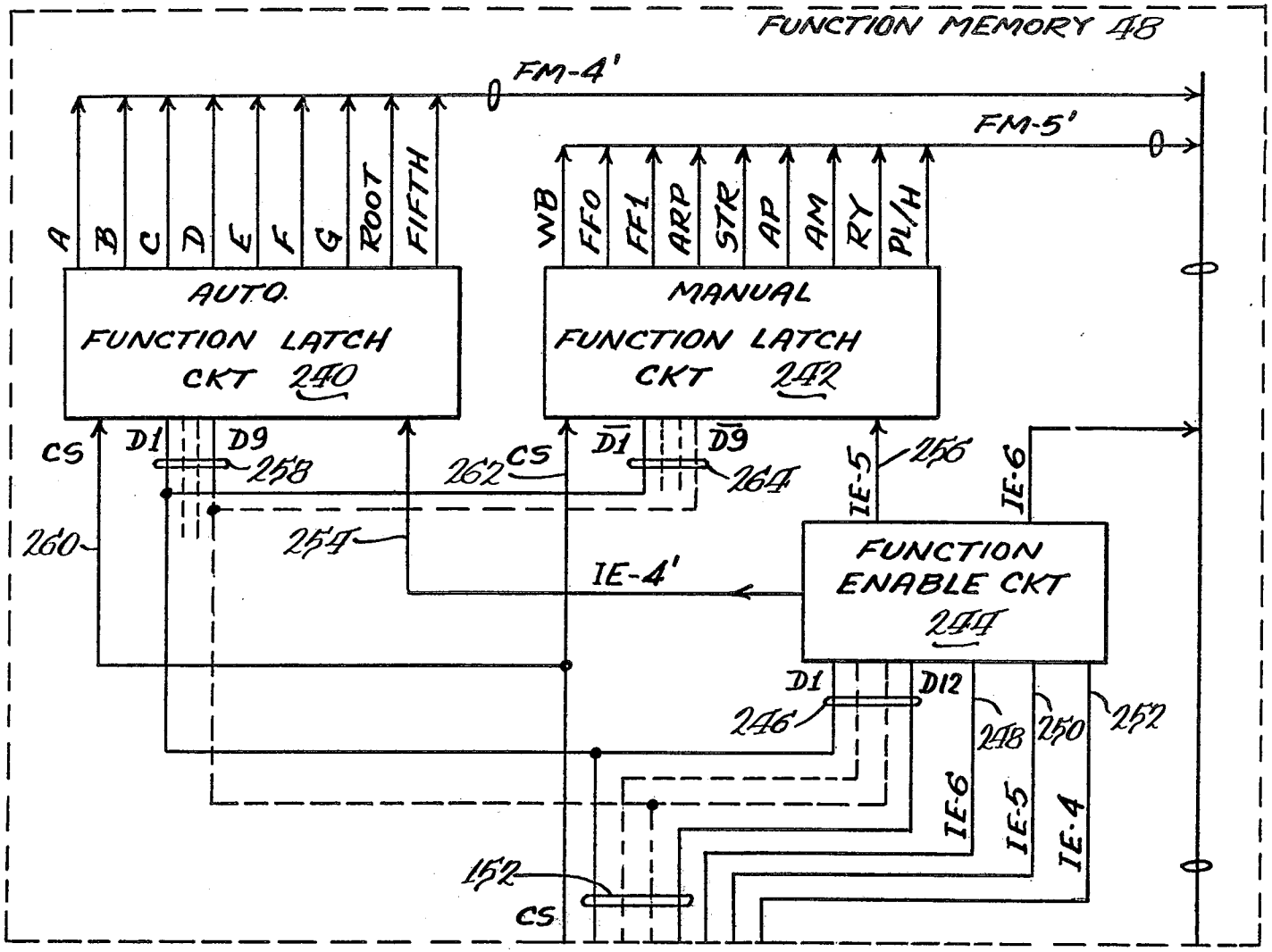
Figure 3C:
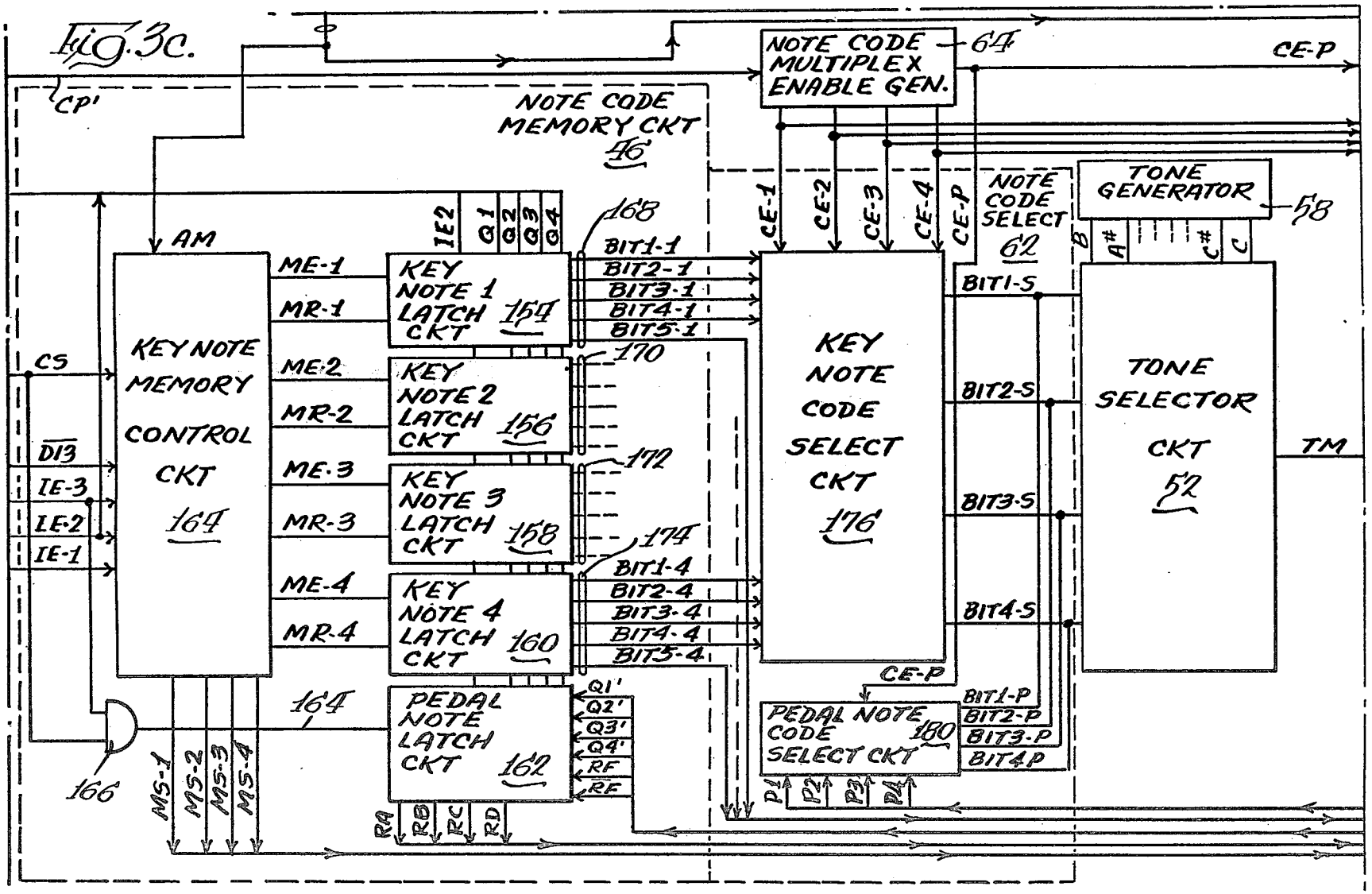
Figure 6A:
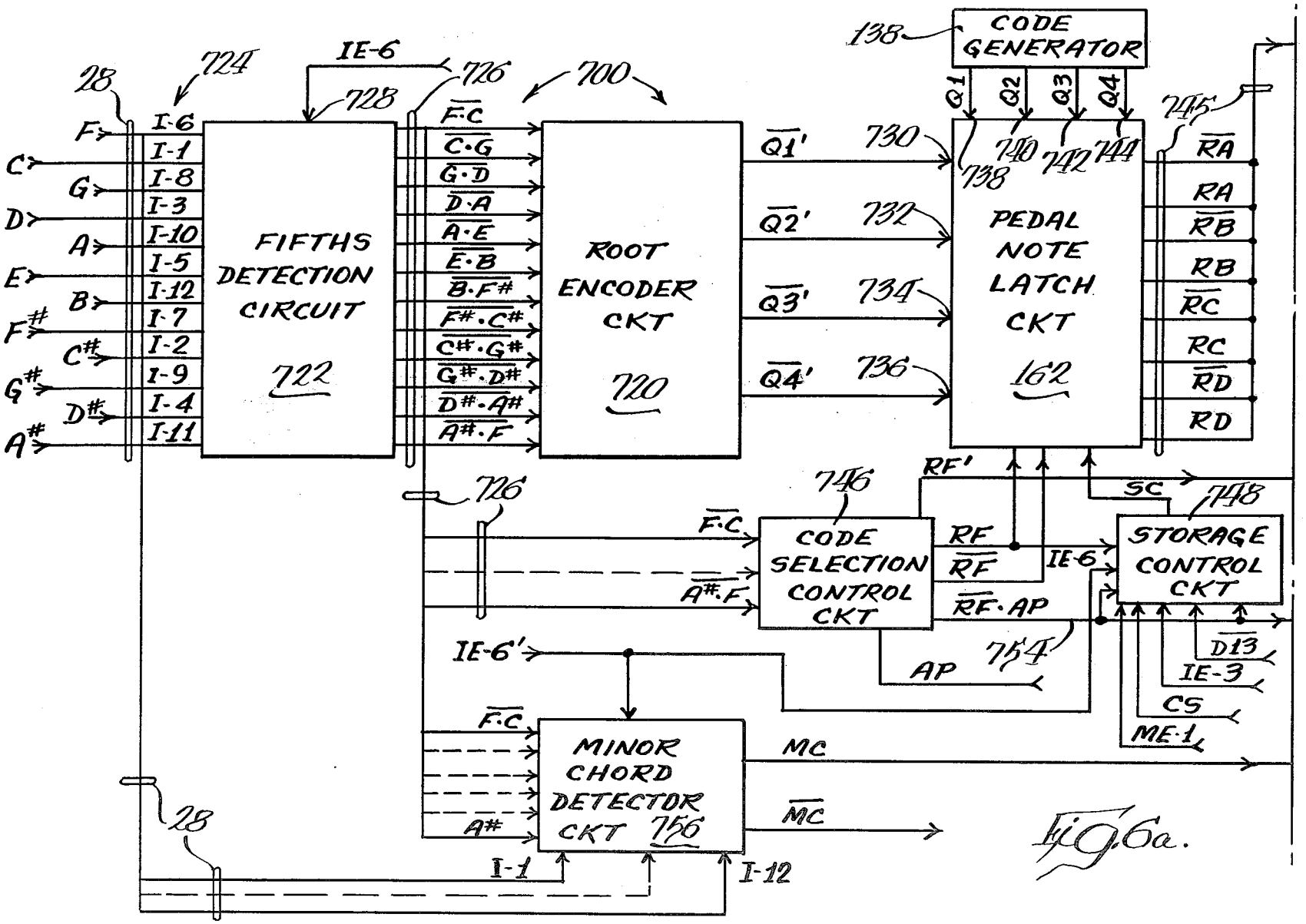
Figure 6B:
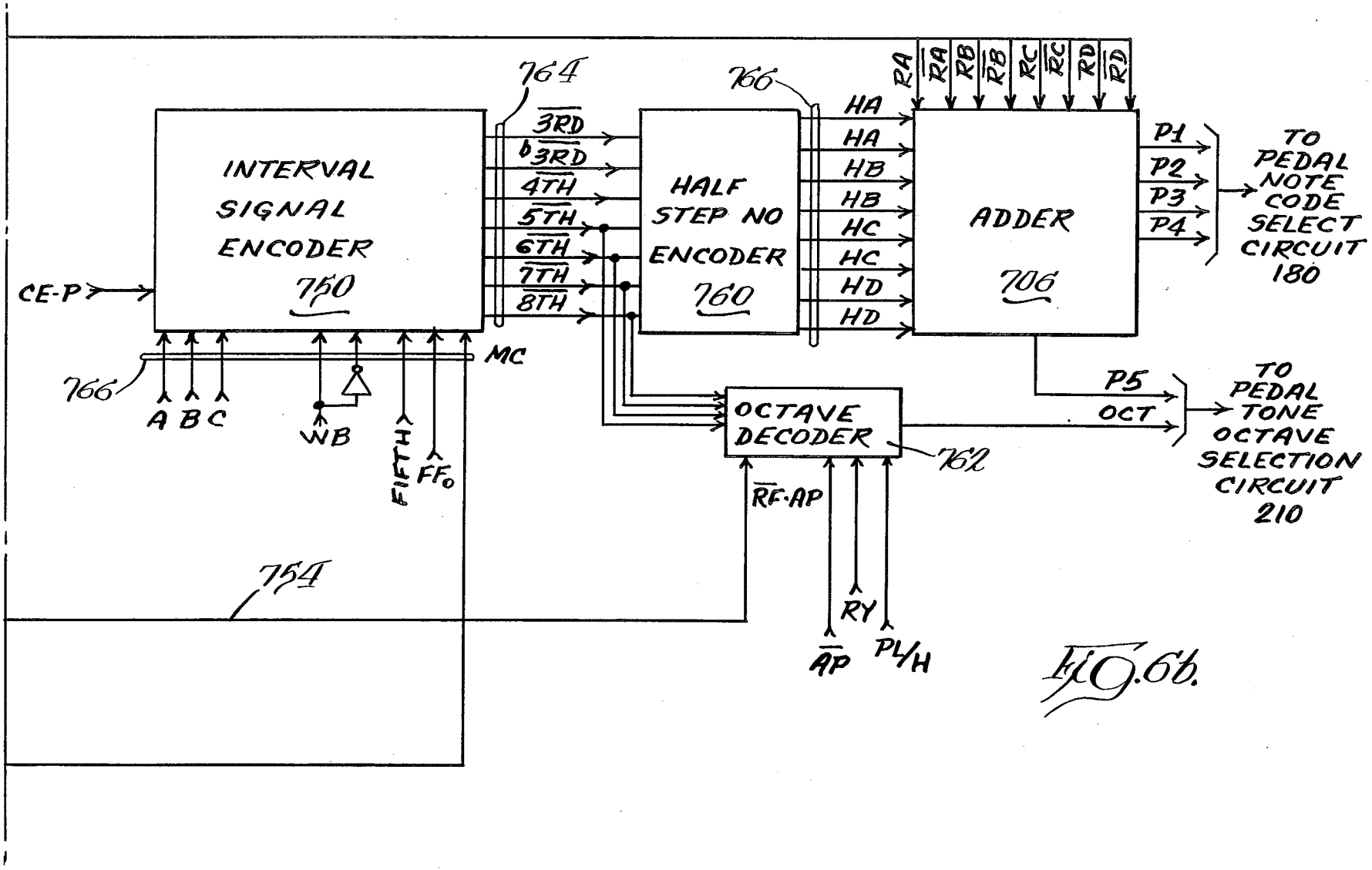

The digital chord generation circuit shown in functional block form in FIGS. 6*a* and 6*b* is responsive to some of the signals generated by the musical instrument of FIGS. 3*a*–3*c* and illustrated in the waveforms of FIG. 4, and employs portions of the circuitry thereof to perform its chord generation function. Accordingly, a description of the operation of the musical instrument of FIGS. 3*a*–3*d* with only brief reference to the chord generation circuit will first be given followed by a more detailed functional description of the digital chord generation circuit of FIGS. 6*a* and 6*b*. The functional block diagram of FIGS. 3*a*–3*d*, the input circuitry of FIG. 5, and the illustrative waveforms shown in FIG. 4 are taken directly from my co-pending application Ser. No. 603,859 entitled, "Note Selector Circuit for Electronic Musical Instrument", assigned to the assignee of the present application. Reference to that application may be made for a description of circuitry corresponding to the functional blocks in FIGS. 3*a*–3*d* to the extent, if any, that such further description is needed for a more complete understanding of the operation of the digital chord generation circuit. The circuitry corresponding to the functional blocks of the digital chord generation circuit shown in FIGS. 4*a* and 6*a* will be described with reference to FIGS. 7*a*, 7*b*, 8 and 9 following the functional description thereof.

III. The Environment For the Digital Chord Generation Circuit

A. Input Circuits and Encoding Logic

FIGS. 3*a*–3*d* show the input and encoding circuitry, which in response to playing of keys and pedals and selection of special functions, encodes this information for processing by the digital chord generation circuit.

In the musical instrument of FIGS. 3*a*–3*d*, the tone generator 58 corresponds to tone signal generator 712 of FIG. 1. The tone selector circuit 52, pedal tone latch 188, pedal and tone octave selection circuit 210 and associated circuitry corresponds to the tone signal selector 714. The auto code generator 108, FIG. 3*a*, corresponds to the interval signal source 702. The root detector 700 includes pedal note latch circuit 162. The other circuitry of the digital chord generator circuit is illustrated as being within special effects circuitry block 38, FIG. 3*d*. All of the remaining circuitry of FIGS. 3*a*–3*d* corresponds to input transfer circuit 710. The keyboard block 708 of FIG. 1 is representative of two octaves of keys of an accompaniment manual keyboard (not shown). A one octave pedal clavier (not shown) is also provided as an alternate source of note information for purposes that will be described below.

Referring first to FIG. 3*a*, the note selection input circuits 32 are seen to comprise three switch circuits 100, 102 and 104. Switch circuits 100, 102 and 104 are respectively associated with two octaves of the accompaniment manual and the one octave of the pedal clavier.

Switch circuit 100 includes twelve key switches, $C_1$, $C\#_1$, $D_1$, $D\#_1$, $E_1$, $F_1$, $F\#_1$, $G_1$, $G\#_1$, $A_1$, $A\#_1$ and $B_1$, respectively associated with the twelve first octave keys. Closure of a key switch and thus selection of a note is effected when the organist depresses the key associated therewith. For example, when the organist presses down the C key of the lowest octave of the accompaniment manual keyboard, switch $C_1$ is closed. The key switches are normally open and are spring-biased to return to their open condition when their associated key is released. The movable contacts of these twelve key switches are respectively coupled to twelve inputs 28 of an encoding logic circuit 30, labeled I-1 through I-12.

Development of output signals from the switches is controlled by signals applied to an enable bus 112. The fixed contacts of all twelve key switches are connected to enable bus 112, and enable bus 112 is connected to an output IE-1′ from an OR gate 114. OR gate 114 periodically provides a 1-state input enable signal to enable bus 112 under control of an input multiplex enable generator 42. During the first and sixth of six input enable periods closure of any one of the switches $C_1$ through $B_1$ results in provision of a 1-state input signal to its associated encoding logic input 28. For example, with switches $C_1$ and $G\#_1$ closed, 1-state signals are provided to inputs I-1 and I-9. When not enabled, i.e., when output IE-1′ of OR gate 114 is in a 0-state, switch circuit 100 is disabled from providing 1-state signals to any of the encoding logic inputs 28.

The multiplex enable generator, as explained in my co-pending patent application, consists of a counter which is responsive to the 14th count of decoder 140, and a decoder. Thus periodic enable pulses are provided during which the encoding circuit is enabled to scan the information inputs from different input circuits such as the manual and the function switches.

The second octave keyboard switch circuit 102 and the pedal clavier switch circuit 104 are both identical to the first octave keyboard switch circuit 100 with the exception that they receive different enable inputs and manual inputs. Accordingly, these switch circuits are shown only in block form. The outputs of the twelve switches of the second octave keyboard switch circuit 102 respectively associated with the twelve keys of the second octave of the accompaniment manual keyboard are respectively labeled $C_2$ through $B_2$. The outputs of twelve switches of the pedal clavier switch circuit 104 respectively associated with twelve pedals of the pedal clavier octave are respectively labeled $C_p$ through $B_p$. The enable bus of the second octave keyboard switch circuit 102 receives its enable signal from an output IE-2′ of an OR gate 116 during the second and sixth input enable periods controlled by input multiplex enable generator 42. The enable bus of the pedal clavier switch circuit 104 receives an enable signal during a third input enable period from an input enable output IE-3 of input multiplex enable generator 42.

The octavely related switches of all three note selection switches are connected in parallel to the encoding logic inputs I-1 through I-12. For example, all of the C note key switches are connected to I-1, and all of the B note switches are connected to I-12. These connections are made through isolation diodes 110 to prevent the feedback of an input enable signal from one of the circuits to another circuit through a closed switch in each.

Turning now to FIG. 5, the source of function information from the input transfer circuit used to control the digital chord generation circuit is a manual function selection input circuit 36. Circuit 36 has a set of nine switches respectively labeled WB, $FF_0$, $FF_1$, ARP, STR, AP, AM, RY and PL/H. These function switches provide means for the organist to manually select a desired special effect or other function to be performed by the organ. Switches AP (auto pedal), WB (walking bass) and $FF_0$ (fancy foot) are directly related to the special effect performed by the digital chord generating circuit, as will be explained in more detail hereinafter. The other switches are related to other special effects circuits of special effects circuitry 38, FIG. 3*d*.

The nine function selection switches of circuit 36 are respectively coupled to encoding logic inputs I-1 to I-9 through isolation diodes 110. Like the keynote switches, all the manual function selection switches are connected to an enable bus 124. Enable bus 124 receives an input enable signal from an output IE-5 of input multiplex enable generator 42 during the fifth input enable period. Unlike the keynote switches, the function selection switches are locking switches so that the organist need not continue to depress the switches for the selected special effect to continue.

An auto function selection input circuit 34 is adapted for receiving function information including interval information from interval signal source 702 within auto code generator block 108. Unlike the other input circuits, circuit 34 does not have switches, but rather has nine identical input circuits 126 respectively connected to nine auto code generator outputs. The interval signal source 702 of auto code generator 108 functions to generate 1-state and 0-state interval code signals on outputs "A", "B", "C" and "FIFTH".

The signals on output A, B and C comprise a binary code indication of the desired interval. Considering the signal on output A being the least significant bit of a binary number, binary counts of one through seven respectively designate the root, third, fifth, sixth, eighth, fourth and seventh intervals. A 1-state signal on the output FIFTH designates the fifth interval and overrides the interval indication on outputs A, B and C in a mode of operation that will be explained hereinafter.

This invention is not concerned with the precise manner in which the interval signal codes are generated on outputs A, B, C and FIFTH, but is rather concerned with the operation performed in response to such signals. Accordingly, the interval signal source 702 is shown only in block form, with the understanding that many conventional circuits are capable of fulfilling this function. All that is required is that different logic 1-state and 0-state signals may be selectively provided on different ones of the outputs A, B, C and FIFTH. For example, the codes could be selectively generated through manually controlled circuitry identical to the switch circuits 100, 102, 104 or 36. It is, however, contemplated that the interval codes be generated automatically and the intervals represented thereby automatically changed according to a predetermined order in rhythm with other musical operation being performed.

Presuming automatic generation of the interval signals from the outputs of NAND gates or the like, input circuits 126, in response to these automatic signals, simulate manual switch closures to the encoding logic inputs 28. Each input circuit 126 comprises a diode 128 with its cathode connected to its associated input and its anode connected to the anode of an associated output isolation diode 130. The junction between diode 128 and 130 of each input circuit 126 is connected through a resistor 132 to an enable bus 134 on which an enable signal on output IE-4 of input multiplex enable generator 42 is periodically provided. The nine input circuits 126 are respectively coupled to encoding logic inputs 28, I-1 through I-9, respectively, through isolation diodes 110.

When a 1-state input enable signal is applied to enable bus 134, a 1-state signal is applied through the resistor 132 and diode 110 to the associated encoding logic input 28 of each input circuit 126 that has its associated input 106 in a 1-state. If the associated input 106 from interval signal source 710 is in a 0-state, the diode 128 is forward-biased, and a 0-state signal is applied to the associated encoding logic input 28. When the enable bus 134 is in a 0-state, i.e., when the auto function selection input circuit 34 is not enabled, 0-state signals appear at the cathodes of all the isolation diodes 130 regardless of the logic states of inputs 106.

Referring now also to FIG. 4, the input multiplex enable generator 42 generates 1-state input enable pulses successively, one at a time, on its output IE-1, IE-2, IE-3, IE-4, IE-5 and IE-6, as illustrated in waveforms b, c, d, e, f, and g of FIG. 4. Thus, encoding logic inputs 28 receive input signals from only one input selection circuit at a time with one exception. The exception is that during the input enable period when IE-6 is in a 1-state, both IE-1' and IE-2' are in a 1-state, and thus both the first and second octave keyboard switch circuits 100 and 102 are enabled. It is during this sixth input enable period that the selected note information for the root detector 700 is received. During this period, the encoding logic circuit 30 cannot distinguish whether a 1-state on one of its encoding logic inputs 28 is from a switch of the first octave circuit 100 or the second octave circuit 102, or both. However, the digital chord generation circuit does not need to distinguish between first and second octaves to perform its function. Except during this sixth input enable period, an enable pulse is generated on IE-1' only during the period that an enable pulse is generated on IE-1 and an enable pulse is generated on IE-2' only when a 1-state pulse is provided on input multiplex enable generator output IE-2.

The input multiplex enable generator 42 and the input circuits 32, 34 and 36 connected therewith provide a means for transferring the input information from each of the input circuits to the encoding logic inputs 28 on a time division multiplex basis. The time division multiplexing is on a circuit-by-circuit basis, with each input circuit being enabled to simultaneously provide signals on a plurality of outputs. Referring to FIG. 3*a*, the input multiplex enable generator 42 is seen to be controlled by an input 136 from encoding logic circuit 30. Encoding logic circuit 30 includes a code generator 138, a decoder 140 and a code selector 142. Code generator 138 comprises a four-bit binary counter which counts high frequency clock pulses on an output CP of a clock pulse generating circuit 40. This clock pulse signal, hereinafter referred to as clock pulse signal CP, is a periodic series of 1-state pulses, as illustrated in waveform "a" of FIG. 4. While other frequencies could be used, a frequency of 250 kilohertz for clock pulse signal CP has been found most suitable. Code generator 138 is a modulo thirteen counter, which means that it successively counts thirteen clock pulses and then is reset to a count of zero.

The count of code generator 138 is represented in binary form on four normal outputs Q1, Q2, Q3, and Q4, and on four inverted outputs $\overline{Q1}$, $\overline{Q2}$, $\overline{Q3}$ and $\overline{Q4}$ in customary fashion. For example, a count of 2 is represented by output Q2 being in a 1-state, and outputs Q1, Q3 and Q4 being in a 0-state. Each of the inverted inputs $\overline{Q1}$ through $\overline{Q4}$ are always in a state which is the inverse of the state of normal outputs Q1 through Q4, respectively.

The binary count of code generator 138 as represented by the various signals on its outputs is converted to a decimal form by decoder 140. Decoder 140 has twelve outputs D1 through D12, respectively associated with the first twelve counts of code generator 138. A 1-state pulse is generated on one of outputs D1 through D12, respectively, in response to binary counts of 1 through 12 of code generator 138. On a count of thirteen, a 0-state pulse is generated on an output $\overline{D13}$ of decoder 140, which is coupled to the keynote memory control circuit 164, FIG. 3*c*, for purposes that will later become apparent. At the end of the thirteenth count, the decoder 140 generates another 0-state pulse on a reset output coupled to code generator 138. This 0-state pulse resets the code generator to a count of zero.

The reset output is also coupled to input 136 of input multiplex enable generator 42. Input multiplex enable generator 42 generates a 1-state enable pulse on one of its input enable outputs IE-1 through IE-6 successively in response to each reset pulse, as illustrated on waveforms b through g of FIG. 4. Thus, during each new complete cycle of operation of code generator 138, an input enable pulse is provided on a different one of outputs IE-1 through IE-6, and a different one of the input selection circuits is enabled.

Decoder outputs D1 through D12 and selection inputs I-1 through I-12, respectively associated therewith, are both connected with code selector 142. The code selector 142 scans inputs I-1 through I-12 in accordance with the decode pulses on outputs D1 through D12, and generates a 1-state code select pulse on its output CS for each input 28 which is in a 1-state when its associated decoder output is in a 1-state. Each code select pulse identifies for storage or further decoding the binary number code being provided by code generator 138 when the code select pulse is generated. These marked codes are thus representative of the inputs 28 which are being provided with 1-state select signals by the input circuitry. Except as noted above, identity of the input enable period during which the code is marked uniquely identifies the input circuit which provided the 1-state select signal to the encoding logic input corresponding to the marked code.

The above described encoding operation is further explained by way of example with reference to waveforms "a" through "h" of FIG. 4. With switches $C_1$ and $D_1$ of the first octave note selection circuit 100 closed, key switches $E_2$, $F\#_2$ and $G_2$ of circuit 102 closed, pedal switch $C\#_3$ of pedal clavier switch 104 closed, the input labeled FIFTH of auto function selection circuit 34 in a 1-state, and function switches $FF_0$ and AM of manual function selection circuit 36 closed, code select pulses would be generated during the time periods illustrated by waveform h of FIG. 4. As seen, during the first input enable period, i.e., the period of time that IE-1 is in a 1-state, a code select pulse is generated when decoder output D1 is in a 1-state and then again when decoder output D3 is in a 1-state. Likewise, during the second enable period, code select pulses would be generated successively when 1-state pulse decode enable pulses are generated on decoder outputs D5, D7 and D8. During the third enable period, a code select pulse is generated when a decode enable pulse is generated on output D2. During the fourth enable period, a code select pulse is generated when a decode enable pulse is generated on output D9. During the fifth input enable period, a code select pulse is generated when a decode enable pulse is generated on output D2 and later when one is generated on output D7. Although not shown, during the sixth input enable period, code select pulses are generated for each interval signal source output in a 1-state. As can be seen by reference to waveform a, each code select pulse is unique to a particular count of code generator 138.

The code select pulses provide an identification to the note code memory circuit 46 FIG. 3C of the note codes of the selected notes during the first three input enable periods. Output CS is also connected to the function memory 48, FIG. 3*b*, to provide an indication thereto to store the code of code generator 138 of the selected function during the fourth and fifth input enable periods.

As will be explained with reference to FIGS. 6*a* and 6*b*, during the sixth input enable period, the code select pulses provide an indication of the notes selected on the accompaniment manual to the root detector 700.

B. Memory and Tone Selection Circuits

Turning to FIG. 3*c*, the operation of the note code memory circuit 46 will first be described. The note code memory 46 includes four keynote latch circuits 154, 156, 158 and 160, and a pedal note latch circuit 162. The four keynote latch circuits 154 through 160 are controlled by a keynote memory control circuit 164. The keynote memory control 164 is responsive to code selector output CS, decoder output D-$\overline{13}$ and the input multiplex enable generator outputs IE-1, IE-2 and IE-3 to perform its control function. All of the keynote latch circuits are controlled to store the signals provided on the code generator 138 outputs Q1–Q4 and the logic state of the input multiplex enable generator output IE-2 connected therewith. The keynote memory control 164 controls keynote latches 154–160 by means of signals provided on its output ME-1 and MR-1, ME-2 and MR-2, ME-3 and MR-3 and ME-4 and MR-4, respectively connected therewith. Memory enable outputs ME-1 through ME-4, when switched to a 1-state, enable the keynote latch circuits associated therewith to store a five-bit note code. The first four bits of the code are provided by the outputs of code generator 138 and designate the note. The fifth bit of the code is provided on output IE-2 and designates the octave of the note. The memory reset outputs MR-1 through MR-4, when switched to a 0-state, reset or clear the associated keynote latches of any codes stored therein.

The keynote memory control 164 generates 1-state memory enable pulses on outputs ME-1 through ME-4 in succession, one at a time, in response to the first four code select pulses occurring during the first two input enable periods. The one keynote latch circuit which is enabled when the code select pulse is generated stores the five-bit binary code being provided at the time of the code select pulse. Selection inputs 28 are scanned from input I-1 connected to the lowest note key switch to I-12 connected to the highest note key switch, and the first octave manual keyboard switches are scanned before the second octave manual keyboard switches.

Accordingly, only the codes for the four lowest selected notes of the two octaves of the accompaniment manual keyboard will be stored in keynote latches 154–160. It will be readily understood that more note codes could be stored if additional keynote latches and associated circuitry were provided.

After the fourth latch is loaded with a note code, no further memory enable pulses are generated until the next scanning cycle and, thus, if five keys on the accompaniment keyboard are simultaneously held down, only the codes of the lowest four notes will be stored. For example, referring to waveform j which indicates the timing of memory enable pulses on outputs ME-1 through ME-4 as generated in response to the code select code pulses shown in waveform h of FIG. 4, it is seen that memory enable pulses are generated on ME-1 through ME-4 in succession respectively in response to the code select pulses for notes C1 and D1 of the first octave and notes $E_2$ and $F\#_2$ of the second octave, while a memory enable pulse is not generated in response to the code select pulse for note $G\#_2$ of the second octave.

The keynote memory control 164 also controls the resetting or clearing of keynote latches 154 through 160 by means of O-state memory reset signals generated on outputs MR-1 through MR-4, respectively connected thereto. The keynote memory control 164 has two modes of operation, a memory mode and a non-memory mode, with respect to memory reset pulse generation. The memory mode of operation permits a player to select up to four notes to continue to be played after the associated keys have been released. This frees one hand to play the solo keyboard in both embodiments while the notes selected on the accompaniment manual continue to be sounded. In the non-memory mode, each keynote latch is reset at the beginning of each memory enable pulse provided thereto.

Two embodiments of the memory control circuit are respectively shown in FIGS. 6*b*, 8, 8*a* and 8*b*, in my copending application noted above, and reference may be made thereto for a detailed description of the two circuit embodiments.

All of those keynote latches which have not received a memory enable pulse, indicating the player has released the key corresponding thereto, are reset in response to the 0-state pulse generated an output $\overline{D13}$ of decoder 140 during the second input enable period. Thus, if no code select pulses are generated, reset pulses are provided to all keynote latch circuits at the end of the second input enable period. Likewise, if only one code select pulse is generated during the first and second enable period, only keynote latch circuits 156, 158 and 160 are reset. If two code select pulses are generated, keynote latch circuits 158 and 160 are reset and, if three code select pulses are generated, only keynote latch 160 is reset. If four or more code select pulses are generated, no memory reset pulses are generated, and the note codes remain stored in all of the keynote latches throughout all of the remaining input enable periods. This, in some instances, is necessary for the special effects circuitry 38 to perform certain functions.

As stated, the note code memory 46 also includes a pedal note latch circuit 162. The pedal note latch 162 provides the root code to adder 706 on outputs RA, RB, RC and RD thereof and is controlled by associated circuitry of the digital chord generation circuit. Two modes of operation are provided depending upon the state of manual function latch output AP. Pedal note latch 162, unlike the keynote latch circuits, receives input note codes from two sources. One code is provided on outputs Q1′, Q2′, Q3′ and Q4′ from associated circuitry of the root detector 700 (FIG. 1). The other note code is provided on the Q1, Q2, Q3 and Q4 outputs from code generator 138 of the encoding logic circuit 30 in response to the note selections on the pedal clavier.

In the non-auto pedal mode of operation, function latch output AP is in a 0-state and the pedal note latch circuit 162 is controlled by inputs RF and $\overline{RF}$ to enter for storage the selected pedal note code during the third input enable period. This code is provided as the root code on the four outputs Q1–Q4 of the code generator 138. Control circuitry in this mode of operation is schematically illustrated in FIG. 3*c* by AND gate 166. AND gate 166 has one input connected to input multiplex generator output IE-3 and another input connected to the code selector output CS. When a code select pulse occurs during the third input enable period, both inputs to AND gate 166 are in a 1-state and a 1-state memory enable pulse is generated on output 164. The code on code generator outputs Q1 through Q4 being presented at that time is then stored. Customarily only one pedal is depressed at a time, and thus only one pedal note latch is provided to store the code of the one pedal note which is selected.

The circuit operates in an auto pedal mode when the auto pedal function has been selected to provide a 1-state signal in function latch output AP, FIG. 3*b*. In the auto pedal mode, the pedal note latch 162 stores the 4-bit code for the lowest selected keynote being presented on code generator counter outputs Q1 through Q4 or the root note code on root detector outputs Q1′ through Q4′, depending upon whether or not a pair of selected notes is detected having a valid root-fifth relationship. If a valid root fifth pair is detected, 1-state and 0-state signals are respectively provided on RF and $\overline{RF}$ outputs of the root detector 700, and the code for the root note from root decoder outputs Q1′–Q4′ is entered into the pedal note latch during the sixth input enable period. If a valid root fifth is not detected as indicated by 0-state and 1-state signals on outputs RF and $\overline{RF}$ respectively, the code for the lowest keynote is entered into the pedal note latch circuit 162 during either the first or second input enable period and used as the root note.

The pedal note latch 162 provides the entered four-bit note code on outputs RA, RB, RC and RD to adder 706 within special effects circuitry 38. Adder 706, in turn, provides note code information to a pedal note code select circuit 180 of a note code select circuit 62 on outputs P1, P2, P3 and P4, and provides octave information to pedal tone octave selection circuit 210 on output P5.

The code provided on outputs P1–P5 depends upon the output states of manual function latch outputs WB and $FF_0$. If the walking bass function is selected, the code on outputs P1–P5 is that obtained by adding the half step number code indicated on interval signal source outputs A, B and C to the code stored in the pedal note latch circuit 162. If the walking bass function is not selected, i.e., WB is in a 0-state, the output code is dependent upon whether the fancy foot function has been selected. With a 1-state on function latch output $FF_0$, the code for the fifth interval note of the stored note is provided on outputs P1–P5 (when a 1-state signal is on signal source output FIFTH). When output FIFTH is in a 0-state, zero half steps are indicated by the interval code generator encoder and the code on outputs P1–P4 is identical to that stored in the pedal note latch.

Note code multiplex enable generator 64 successively generates 1-state code enable pulses CE-1 through CE-2 and CE-P on its five outputs one at a time at a frequency determined by a clock pulse output signal on an output CP' from a clock 40. To ensure that the code stored in each of the note latches will be transferred to tone selector 52 during the period of storage therein, the note code multiplex enable pulses are generated at a greater frequency than the frequency at which input multiplex enable pulses are generated by input multiplex enable generator 42. The clock pulse frequency of 1 MHz on output CP' for a frequency of 250 KHz on output CP has been found suitable.

The keynote code select circuit 176 has only four outputs, respectively labeled bit 1-S through bit 4-S, on which all of the note codes are transferred to the tone selector 152. The first four bits of the keynote codes stored in latches 154, 156, 158 and 160 are developed in succession on outputs bit 1-S through bit 4-S, respectively, in response to 1-state code multiplex enable pulses on inputs CE-1, CE-2, CE-3 and CE-4. Likewise, the four bits of the code on adder outputs P1–P4 are provided on pedal note code selector 180 outputs bit 1-P through bit 4-P in response to a 1-state code multiplex enable pulse on input CE-P.

The manner in which the note codes are transferred to the tone selector 52 is illustrated by waveforms l, m and n of FIG. 4. Waveform m illustrates the signal on one of the outputs of keynote code selector circuit 176 developed in response to enable pulses on CE-1 when the associated one of outputs 168 of keynote latch circuit 154 is in a logic 1-state. Waveform n illustrates the signal on one of the outputs of keynote code select circuit 176 generated in response to enable pulses on CE-3 when the associated one of outputs 172 of keynote latch circuit 158 is in a 1-state. Note code multiplex enable generator 64 generates note code enable pulses continuously. Thus, a 1-state code bit will result in development of 1-state pulses on the corresponding output of keynote code select circuit 176 during development of note code multiplex enable pulses on outputs CE-1 through CE-4 and CE-P from initiation of storage in a note latch until the latch is reset. If a stored code bit is a binary logic zero, no pulses are generated on the corresponding output of keynote code select circuit 176.

Tone selector circuit 52, during each code enable period, selects from the twelve tone signals provided by tone generator 58 the tone signal corresponding to the note code presented during that period and generates a 1-state tone signal pulse on its output TM. Tone signal pulses are generated on output TM in response to presentation of the binary code corresponding thereto only during those periods of time when the tone signal is also in a logic 1-state, as illustrated in waveform o. Those tone signal pulses are illustrated for the multiplex enable pulses shown in waveform m and n. The tone signal pulses for all five selected tones are of course all multiplexed together on output TM. Waveform o illustrates the waveform which would result if only one note latch contained a note code.

C. Tone Latch and Special Effects Circuits

Figure 3D:
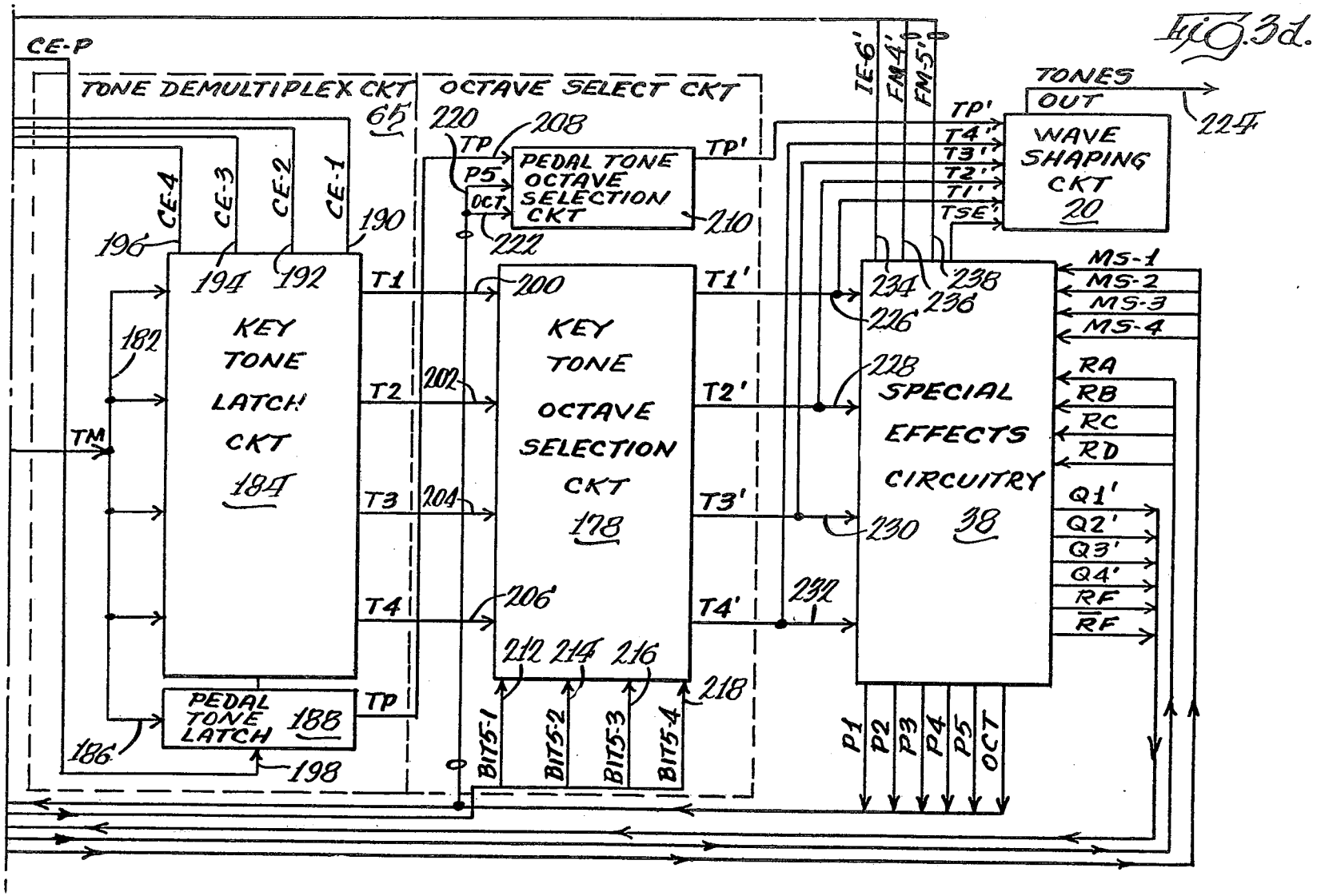
Figure 11:
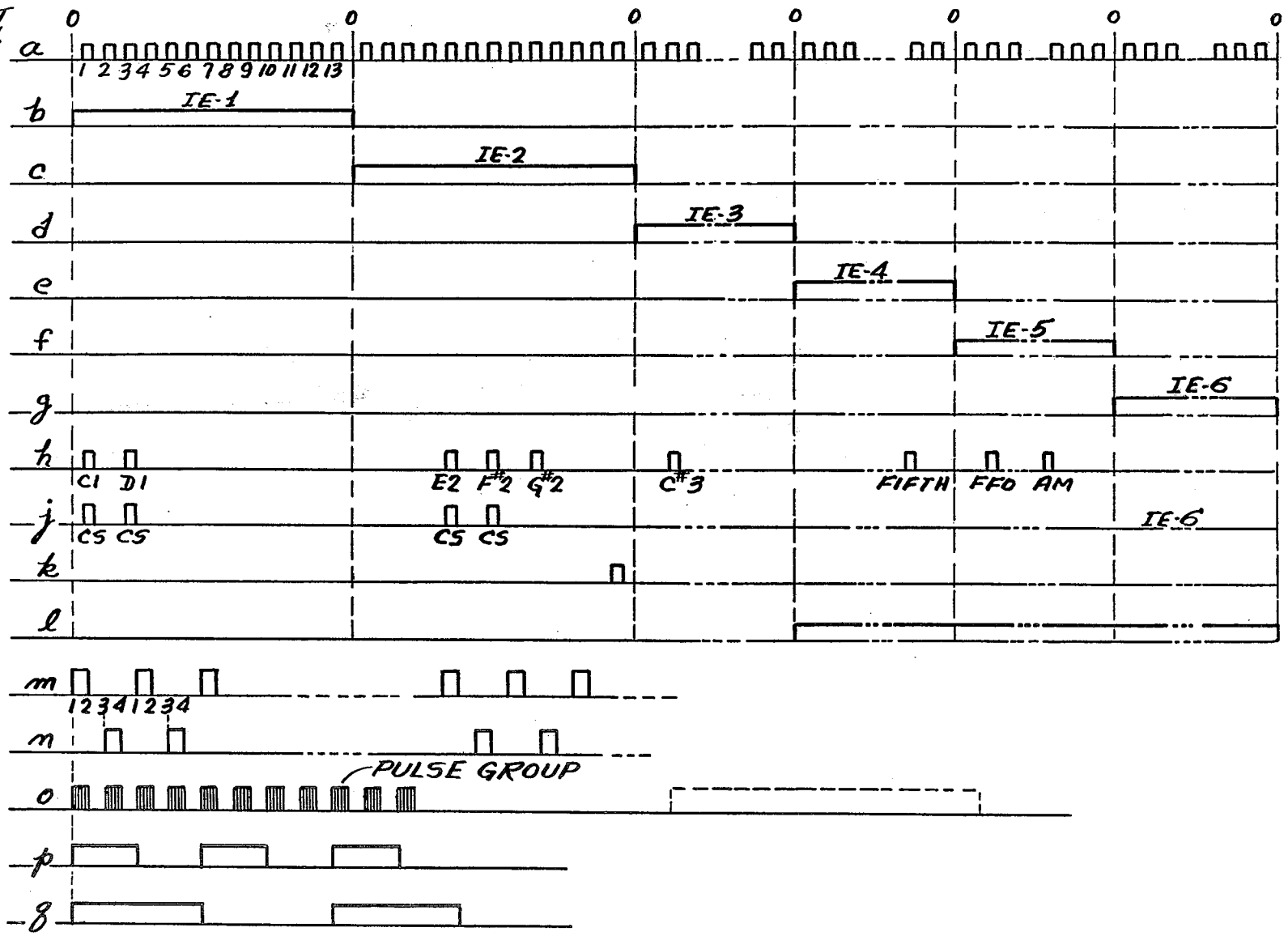

Turning now to FIG. 3*d*, output TM is connected to an input bus 182 of a keytone latch 184 and to an input 186 of a pedal tone latch 188 which together comprise a tone demultiplex circuit 65. Demultiplexing by the keytone latch circuit 184 is achieved through response to signals at inputs 190, 192, 194 and 196 thereof respectively provided by note code multiplex enable generator 64 outputs CE-1, CE-2, CE-3, and CE-4. Demultiplexing by the pedal tone latch circuit 188 is achieved through response to the enable signals at an input 198 thereof provided by the note code multiplex enable generator output CE-P.

The tone demultiplex circuit 65 separates the tone pulse signals from all five of the signals appearing on output TM and simultaneously provides them on outputs T-1, T-2, T-3, T-4 and T-P, respectively. The tone signals on outputs T-1 through T-4 are those respectively selected in accordance with the binary note codes stored in keynote latches 154–160. The tone signals on output T-P of pedal tone latch 188 is the one selected in accordance with the note code from adder 706.

Referring again to waveform o of FIG. 4, it is seen that during the logic 1-state of the tone signal, the output signal on TM for a single selected tone comprises a rectangular wave train of high frequency pulse groups. The frequency of the pulses forming each pulse group is the frequency at which the note code multiplex enable generator 64 generates the code enable pulses. The frequency at which the pulse groups are generated is dependent on the tone signal frequency.

The tone demultiplex circuit 65, in addition to demultiplexing or separating the different tone pulse signals according to the five selected tones, removes the high frequency multiplexing signals imposed thereon. The tone signals generated on the outputs of the tone demultiplex circuit 65 are substantially identical to the tone signals provided by tone generator 58 with the exception that the tone signals 1-state pulse may be shortened by a slight amount. This shortening occurs whenever the tone signal switches to a 1-state during a period of time that the latch corresponding thereto is not being scanned, as illustrated by waveforms p and q. Thus, this amount can be no greater than the time period between successive multiplex enable pulses. With a tone signal frequency of 1,000 Hz and a note code multiplex enable pulse frequency of 50 KHz, the shortening of the tone signal is no greater than 2%. This amount has been found to be undetectible in the resulting audible output. The use of higher frequencies for multiplexing can be course reduce the distortion even further.

The demultiplexed tone signals on outputs T-1 through T-4 and T-P are applied to the octave select circuit 67 which selectively reduces the frequencies thereof in accordance with the fifth bit of the note codes corresponding thereto and provides the octave selected tone signals on outputs T-1' through T-4' and T-P', respectively. The octave select circuit 67 includes a key tone octave selection circuit 178 and a pedal tone octave selection circuit 210. The demultiplexed key tones on outputs T-1 through T-4 are received at tone signal inputs 200, 202, 204 and 206 of key tone octave selection circuit 178 and the demultiplexed tone on output T-P of pedal tone latch 188 is received at an input 208 of a pedal note octave selection circuit 210.

The key tone octave selection circuit 178 also has octave information inputs 212, 214, 216 and 218 for respectively receiving the bit 5 outputs of keynote latch circuits 154, 156, 158 and 160. The signals on inputs 212, 214, 216 and 218 respectively determine the octave selection of the demultiplexed tone signals at inputs 200, 202, 204 and 206. If the 4-bit code corresponding to a demultiplexed tone signal is selected for storage during the first input enable period, a logic 0 is stored in the bit-5 location of the latch. If the note code is selected for storage during the second input enable period, a 1-state signal is entered into the fifth bit location of the latches. The key tone octave selection circuit 178 in response to a 0-state at its octave information input divides the demultiplexed tone signal at its tone signal input and provides an octave selected tone signal on its output having a frequency equal to half the frequency of the demultiplexed tone signal applied to its input. If, on the other hand, the bit-5 output from the latch associated with the demultiplexed tone signal is in a 1-state, no division occurs and the octave selected tone signal provided at the output has the same frequency as the input tone signal.

The pedal tone octave selection circuit 210 is similarly controlled in accordance with signals applied to inputs 220 and 222 on outputs P-5 and OCT, respectively, from adder 706 of special effects circuitry 38. A 0-state signal at either one of the inputs 220 and 222 reduces the output frequency to one-half of the input tone frequency while 0-state signals at both inputs reduces the output tone frequency to one-fourth the input tone frequency.

The five octave selected tone signals are all connected to wave shaping circuit 20 which provides the appropriate wave shaping thereto to achieve the desired timbre, etc., and are then applied to a suitable speaker system (not shown) for conversion to audible sound.

The octave selected tone signals on outputs T-1', T-2', T-3' and T-4' are also connected to inputs 226, 228, 230 and 232 of special effects circuitry 38. Special effects circuitry 38 operates on the octave selected key tone signals in accordance with signals respectively applied to an input 234, a plurality of inputs 236 and a plurality of inputs 238 from outputs IE-6', FM-4' and FM-5' of function memory circuit 48.

D. Function Memory Circuit

Referring to FIG. 3*b*, function memory circuit 48 includes an auto function latch circuit 240 which provides function signals on outputs FM-4', a manual function latch circuit 242 which provides function signals on outputs FM-5', and a function enable circuit 244 providing control signals for entry of data into the latches. Each of function latch circuits 240 and 242 has nine 1-bit storage elements or latches for respectively storing the nine functions selectable at their associated function selection input circuits. The function selection input information is transferred to the function latches on a time division multiplexing basis by employing part of the same circuitry used to transfer the note selection information to the note latches.

The function enable circuit 244 has twelve inputs 246 respectively connected to outputs D1 through D12 of decoder circuit 140 and three inputs 248, 250 and 252 respectively coupled to outputs IE-6, IE-5 and IE-4 of input multiplex enable generator 42. In response to signals at these inputs, the function enable circuit 244 generates function code enable pulses on three outputs thereof, IE-4', IE-5' and IE-6'. Output IE-6' is connected to special effects circuitry 38 which is controlled in accordance with signals thereon. The function code enable pulses developed on outputs IE-4' and IE-5' respectively enable auto function latch circuit 240 and manual function latch circuit 242 to respond to function selection information.

The interval signal code bits from interval signal source 702 are provided on function latch outputs "A", "B", "C" and "FIFTH" of circuit 240. The organist's selections of walking bass, fancy foot, pedal low/high and auto pedal are respectively indicated as logic 1-state signals on outputs WB, $FF_0$, AP and PL/H of circuit 242.

Specifically, auto function latch circuit 240 also has nine inputs 258 respectively for receiving decode pulses from decoder outputs D1 through D9, and an input 260 coupled with code selector output CS. The nine 1-bit function codes on outputs FM-4' are respectively associated with the nine input circuits 126 of auto function selection input circuit 34 (FIG. 5) bearing the same labels. If a 1-state signal is provided on the output of one of the auto function selection input circuits 126 during the fourth input enable period, 1-state pulses are simultaneously provided at inputs 260 and 254 and at the associated input 258. The auto function latch circuit 240 in response thereto stores the selection by means of the 1-bit latch associated with the output corresponding to the selected function. For example, if a 1-state is provided from the input circuit 126 labeled "FIFTH", a logic-1 is entered into the 1-bit latch associated with the output FM-4' of auto function latch circuit 240 labeled "FIFTH".

Manual function latch circuit 242 operates in an identical fashion as the auto function latch circuit 240 and generates function selection signals on nine outputs FM-5' respectively corresponding to function selection switches 36 bearing the same label. If a particular function switch is closed, such as switch WB, the latch of output WB is set in a 1-state condition during the fifth input enable period. The selected latch assumes its 1-state condition in response to a code select pulse at its input 262 occurring simultaneously with a pulse on input 256 and a decode pulse occurring on the corresponding one of nine inputs 264 respectively associated with outputs D1 through D9 of decoder 140.

The selected latches of both auto function latch circuit 240 and manual function latch circuit 242 remain in their latched state so long as a code select pulse is generated on their respective inputs 260 and 262 during occurrence of a decode pulse on the appropriate one of their respective inputs 258 and 264. The code select pulse continues to be generated at the proper time so long as the switch of manual function selection circuit 36 corresponding thereto remains closed or the input 106 of auto function selection circuit 34 corresponding thereto remains in a 1-state. Upon occurrence of a decode pulse on the corresponding one of the inputs 258 or 264 and in the absence of a code select pulse, the selected latch is cleared or reset and the function select indication is removed from the associated function memory output.

IV. Digital Chord Generation Circuit—Detailed Description

A. Functional Description

As explained above the digital chord generation circuit responds to selection of notes on the keyboards and selection of special functions, such as walking bass to select a root note code and then to algebraically add interval codes thereto to arrive at codes for chordally related note codes which are then decoded in other circuits.

A detailed functional block diagram of the digital chord generation circuit employed with the electrical musical instrument described above with reference to FIGS. 3*a*–3*d* is shown in FIGS. 6*a* and 6*b*. The pedal note latch circuit 162 and code generator block 138 previously shown in FIG. 3c is again shown in FIG. 6a together with the appropriate connections to the remaining portion of the digital chord generation circuit previously described as being contained within special effects circuitry block 38 of FIG. 3d.

Referring now to FIG. 6a, it is seen that in addition to the pedal note latch circuit 162, a root encoder 720 and a fifths detection circuit 722 correspond to the root detector block 700 of FIG. 1. The fifths detection circuit 722 is enabled during the sixth input enable period to detect whenever two selected notes from either one of the manual keyboard switch circuits 100 and 102 are related by five half steps. Detection is achieved in response to the input signals at twelve inputs 724 respectively connected with the twelve encoding logic inputs 28. The twelve inputs 724 are respectively labeled F, C, G, A, E, B, F#, C#, G#, D# and A# for the twelve notes of each octave, and connected with the encoding logic inputs 28 in the manner indicated in FIG. 6a. A 1-state signal on any input indicates selection of the note associated therewith.

Detection circuit 722 has twelve outputs 726 respectively associated with the twelve possible pairs of related root and fifth notes around the circle of fifths. These outputs are respectively labeled $\overline{FC}$, $\overline{CG}$, $\overline{GD}$, $\overline{DA}$, $\overline{AE}$, $\overline{EB}$, $\overline{BF\#}$, $\overline{F\#C\#}$, $\overline{C\#G\#}$, $\overline{G\#D\#}$, $\overline{D\#A\#}$ and $\overline{A\#F}$ with the indicated pairs of letters for each output representing the fifths related note pair associated therewith. The first letter of each letter pair designating the respective outputs 76 designates the root note, and the second letter designates the fifth.

During the sixth input enable period, a 1-state enable period from output IE-6 of input multiplex enable generator 42, FIG. 3a, is applied to an enable input 728 of fifths detection circuit 722 to enable it during this period to respond to 1-state signals applied to its inputs 724. During this sixth input enable period, 1-state input enable signals are also applied on outputs IE-2' and IE-1', and thus during this period, the signals appearing at inputs 724 are dependent upon the state of the various keyboard switches of switch circuits 100 and 102. For example, if either or both of switches $C_1$ and $C_2$ are closed, a 1-state signal will be provided to the C input.

Whenever a valid root-fifth pair is detected, fifths detection circuit 722 generates a 0-state signal on the associated output. For example, if 1-state signals are provided to the F and C inputs, a 0-state signal is generated on the output $\overline{FC}$. Likewise, with 1-state signals on the C# and G# inputs 724, for instance, a 0-state detection signal is generated on the $\overline{C\#G\#}$ output 726.

The fifths detection circuit 722 establishes a priority through the circle of fifths and generates a detection signal on only the output of highest priority in the event that more than one valid root-fifth pair is detected. Priority decreases downwardly through the outputs 726 shown on FIG. 6a with the root fifth pair F and C having the highest priority and the root-fifth pair A# and F having the lowest priority.

The root encoder circuit 720, in response to the one 0-state detection signal being provided thereto, encodes that signal in binary form and provides on its outputs Q1', Q2', Q3' and Q4' a binary code representative of the root of the detected highest priority root fifth pair.

The root code is a 4-bit binary number with binary counts of 1 through 12 respectively representative of root notes C, C#, D, D#, E, F, F#, G, G#, A, A# and B of the twelve-note scale. Output Q1' carries the least significant bit. For example, note C is represented by binary number one or 0001, and the root note B, the twelfth and last note of the scale, is represented by the binary number twelve or 1100.

The root code signals on outputs Q1' through Q4' are respectively provided to inputs 730, 732, 734 and 736 of pedal note latch circuit 162. As discussed above with regard to FIGS. 3a–3d, pedal note latch circuit 162 also receives pedal note codes from outputs Q1, Q2, Q3 and Q4 of code generator 138. These outputs are respectively applied to inputs 738, 740, 742 and 744. The pedal note latch circuit 162 stores the root code on inputs 730–736 or the pedal note code on inputs 738–742 under control of a code selection control circuit 746 and a storage control circuit 748. The four bits of the selected code from Q1'–Q4' or Q1–Q4 are stored and provided on outputs RA, RB, RC and RD, respectively. The inverse of the signals on outputs RA–RD are respectively provided on outputs $\overline{RA}$, $\overline{RB}$, $\overline{RC}$ and $\overline{RD}$. The inverted outputs $\overline{RA}$–$\overline{RD}$ are connected to interval signal encoder 750 and all of the outputs 745 are connected to a modified modulo 12 adder 706 for purposes that will be described hereinafter.

As discussed above, two modes of operation are provided. In the non-auto pedal mode, in response to the 0-state signal on output AP, control circuit 746 generates a 0-state signal on its output RF and a 1-state signal on its $\overline{RF}$ output. Pedal note latch circuit 162, in response to these states of outputs RF and $\overline{RF}$, selects for storage the codes provided at inputs 738–744 from code generator 138. The selected note code is entered into storage in response to a 1-state pulse generated on an output SC of storage control circuit 748. The storage control circuit 748 senses the non-auto pedal mode condition through a 0-state signal on a code selection control circuit output 754 and a 0-state signal on output RF. With this condition being sensed, the storage control circuit generates a 1-state pulse on output SC in response to the first code select pulse generated during the third input enable period. Thus, the code for the selected pedal note is stored.

The code select pulse is taken from encoding logic output CS and the third input enable period is sensed through connection with input multiplex enable generator output IE-3, FIG. 3a. Storage control circuit 748 also has an input connected with the $\overline{D13}$ output of decoder 140, FIG. 3a, and is responsive to the signal thereon to prevent generation of a 1-state storage control pulse on its output SC in response to other than the first code select pulse occurring during the third input enable period.

When the auto pedal function is selected and manual function latch circuit output AP is in a 1-state, the circuit operates in the auto pedal mode of operation. With AP in a 1-state, the logic states of outputs RF and $\overline{RF}$ are dependent upon whether a valid root-fifth pair has been detected by circuit 722. Code selection control circuit 746 has twelve inputs respectively connected with the twelve detection outputs 726. If a 0-state detection signal is generated on any of these outputs thereby indicating a valid root-fifth pair, code selection control circuit 746 provides a 1-state signal on its output RF and a 0-state signal on its output $\overline{RF}$. If a valid root-fifth is detected, the pedal note latch circuit 162, in response to a 1-state signal on output RF, selects for storage the codes applied to its inputs 730–736 from the root decoder circuit 720.

The code selection control circuit 746 also provides an output 754 having a logic state signal equivalent to the logical conjunction of the signals on outputs $\overline{RF}$ and AP employed by circuitry described hereinafter. When a 0-state signal is on either $\overline{RF}$ or AP, a 0-state signal is generated on output 754. The storage control circuit 748, in response to the 0-state signal on $\overline{RF}$ or AP and the 1-state signal on output RF, functions to cause the root code to be entered into storage. A 1-state storage control signal is generated on output SC in response to the 1-state signal generated on function enable circuit output IE-6′ during the sixth input enable period.

If a valid root-fifth pair is not detected when operating in the auto pedal mode, 1-state and 0-state signals are respectively provided on outputs $\overline{RF}$ and RF and the codes from code generator 138 are selected for storage. The storage control circuit 748, in response to nondetection of a root-fifth, then functions to generate a 1-state storage control pulse on its output SC in response to a 1-state memory enable pulse on keynote memory control circuit output ME-1, FIG. 3c. The code entered into pedal note latch circuit 162 is therefore the code for the lowest selected note from the manual keyboard switch circuits 100 and 102.

In addition to the above-described circuitry for providing the basic root code information, root detector 700 includes means for providing an indication of whether the selected notes comprise a minor chord. This is performed by a minor chord detector circuit 756 in response to signals on twelve inputs connected with the encoding logic inputs 28 and twelve inputs connected with the twelve detection circuit outputs 726. Whenever a valid root-fifth pair is detected during selection of a note which is the flatted third of the root i.e. which is removed three half step intervals from the root, minor chord detector circuit 756 generates a 0-state signal on its output $\overline{MC}$. When a minor chord has not been selected, a 1-state signal is provided on output MC. This detection is performed during the 1-state enable pulse on output IE-6′ connected with detector 756. A 0-state minor chord detection signal output $\overline{MC}$ is stored by detector 756 until the next IE-6′ enable period during which a minor chord is not sensed.

Referring particularly to FIG. 6b, the interval code generator 704 is seen to include an interval signal decoder 750, a half-step number encoder 760 and an octave decoder 762. The interval signal decoder 750 selectively provides a 0-state interval signal on one of seven outputs 764 in accordance with interval code signals and function control signals supplied to eight information inputs 766 thereof. The seven outputs 764 are respectively labeled $\overline{3rd}$, $\overline{\flat 3rd}$, $\overline{4th}$, $\overline{5th}$, $\overline{6th}$, $\overline{7th}$ and $\overline{8th}$ for the code intervals associated therewith. The interval signal decoder 750 is enabled in accordance with the CE-P signal from note multiplex enable generator 64. The interval signal decoder 750 is enabled to respond to the interval and function information signals at inputs 766 only when the pedal note code select circuit is enabled as indicated by a 1-state signal on output CE-P and the code has been entered into the pedal note latch circuit 162.

When enabled, interval signal decoder 750 responds to the interval signal from outputs A, B and C and minor chord signal on $\overline{MC}$ or the interval signal on output FIFTH depending on the logic states of function latch outputs WB and $FF_0$. If WB in a 1-state thus indicating selection of walking bass response is only to the signals on A, B, C and $\overline{MC}$. Interval signals are respectively generated on outputs 4th, $\overline{5th}$, $\overline{6th}$, $\overline{7th}$ and $\overline{8th}$, respectively, in response to logic state signals on function latch outputs A, B and C representative of binary counts of 6, 3, 4, 7 and 5 if output A is considered as the least significant bit of a three-bit number. For example, with outputs C, B and A respectively being in the logic state 100, i.e., a binary 4, a 0-state signal is generated on output 6th. A 0-state interval signal is generated on the output $\overline{3rd}$ in response to a binary count of 2 from outputs A, B and C when output $\overline{MC}$ from minor chord detector is in a 1-state. If $\overline{MC}$ is in a 0-state, a 0-state interval signal is generated on $\overline{\flat 3rd}$ in response to a binary count of 2 from outputs A, B and C.

If the WB output is in a 0-state, the interval signal decoder responds only to the interval signal at input 766 from auto function latch circuit output FIFTH depending upon whether or not the fancy foot function has been selected. If the fancy foot function has been selected and a 1-state signal is provided on output $FF_0$, a 0-state interval signal is generated on the 5th output 764 in response to a 1-state signal applied to the input 766 from the FIFTH output of the function latch. If the fancy foot function has not been selected, and thus $FF_0$ is in a 0-state, then no interval signals are generated on any of outputs 764 and a zero or root interval is presumed.

The half step number encoder 760 encodes the interval information from interval signal decoder 764 into a binary code and provides this code on its output HA, HB, HC and HD. The binary code for each interval signal is the binary number representation for the number of half steps which must be added to the root note to arrive at the note having the desired interval with the selected root note. The signal on HA represents the least significant bit of the binary number. To arrive at the note which is the third of the root note, four half steps or semi-tones must be taken from the root note.

The number of half steps from the root for the intervals of ♭3rd, 3rd, 4th, 5th, 6th, 7th, and 8th are 3, 4, 5, 7, 9, 10 and 12. Accordingly, half step number encoder 760 generates binary codes on its outputs HA-HD with binary counts of 3, 4, 5, 7, 9, 10 and 12, respectively in response to 0-state interval signals on outputs $\overline{\flat 3rd}$, $\overline{3rd}$, $\overline{4th}$, $\overline{5th}$, $\overline{6th}$, $\overline{7th}$ and $\overline{8th}$. For example, logic state signals of 0100 are respectively generated on outputs HD-HA in response to an interval signal on output $\overline{3rd}$, which is of course the binary representation for the number four.

The half step number count is added to the binary root note code stored in pedal note latch circuit 162 by adder 706. Adder 706 arithmetically adds the binary number of the root code with the binary number of the half step number code to generate the chord note code on outputs P1–P4 and the octave code on output P5. Outputs P1–P4 carrying the 4-bit chord note code are connected to the pedal note code select circuit 180, FIG. 3c.

Adder 706 is a modified modulo 12 adder and assigns the fifth or most significant bit output a value of twelve and returns the next three most significant bit outputs to zero and the least significant bit to one when the sum of the two code numbers being added is thirteen. Accordingly, the four least significant bits represent the chord note and the fifth or most significant bit represents the octave. If the sum exceeds the twelve by more than one, a 1-state appears in the most significant bit, and the number by which twelve has been exceeded is represented by the four least significant bits in customary binary numbering convention. For example, when adding the binary numbers for 9 (1001) and 8 (1000), totaling 17 or 12+5, the output is 10101. The 1 in the fifth bit location represents the number twelve, and the 0101 appearing in the four least significant bit locations is the binary representation for the number five. If the sum is twelve or less, then the fifth bit output P5 contains a logic-0, and the four least significant bit outputs P4-P1 represent the total of the two numbers in binary form. For example, the logic states of the signals on outputs P5-P1 is 01001, respectively, when the binary numbers 4 and 5 are added and is 01100 when the sum is twelve.

A tone signal is generated on output TP of pedal tone latch 188 corresponding to the note code on outputs P4-P1 through operation of the tone selector circuit 52 and pedal tone latch circuit 188 in the manner described above with reference to FIGS. 3*c* and 3*d*.

There being only twelve notes to the scale, a 1-state signal on the fifth or most significant bit output P5 indicates that the chord note is in a higher octave than the root note. For example, if the root code is a binary four or 0100 (which represents note D#, the fourth note of the scale), and the half step number code is a binary nine or 1001 indicating nine half steps for the sixth interval, the generated chord note code is 10001. The four least significant bits 0001 represent a binary one, the code for the chord note C, which is the sixth of the root note D#. The most significant bit, having a logic-1 value, indicates that the selected chord note C is in a higher octave than the root note D#. Accordingly, output P5 is connected to the pedal tone octave selection circuit 210 which, as explained above, in response to a 1-state signal on the P5 output, raises the pedal tone signal on output TP by one octave.

The octave of the pedal tone signal on output TP' is also controlled in accordance with the logic state of the signal provided on the OCT input 222 to pedal tone octave selection circuit 210. If input 222 is in a 1-state, the octave selected pedal tone on output TP' is raised by one octave. If the signal on input 222 is in a 0-state, then the octave for the selected pedal tone signal is not raised.

Generation of this octave control signal is provided by octave decoder 762. Octave decoder 762 has one input connected with the $\overline{AP}$ output from the manual function latch, one input connected with the PL/H (pedal low/high) output from the manual function latch and another input from the output 754 from code selection control circuit 746.

When not in the auto pedal mode, the pedal low/high function switch provides a means for the operator to selectively raise the frequency of the selected pedal tone signal by one octave. If the pedal low/high function is selected, the 1-state signal on output PL/H causes the octave decoder 762 to generate a 1-state signal on its OCT output. The pedal tone octave selection circuit in response thereto raises the pedal tone signal by one octave. If the pedal low/high function is not selected, a 0-state signal is provided on output OCT and the pedal tone frequency is not selected. Only the octave of pedal tone signals selected through the pedal clavier can be controlled by the pedal low/high switch.

If the auto pedal mode has been selected, the 1-state signal on output AP and a 0-state signal on output $\overline{AP}$ disables the octave decoder 762 from responding to the output signal on PL/H. If a valid root-fifth pair is not detected when in the auto pedal mode, as indicated by a 1-state signal on output 754 from code selection circuit 746, the octave decoder 762 responds to interval signals on outputs 5th, 6th, 7th and 8th from interval signal decoder 750 and thus plays the low note in the next higher octave on these counts. If a 0-state interval signal is provided at any of these outputs, the octave decoder 762 generates a 1-state signal on its OCT output. If not, a 0-state signal is provided on the OCT output.

If a valid root-fifth pair is detected, however, then the octave decoder 762 provides a 0-state signal on its OCT output regardless of the interval signal from interval signal detector 750.

B. Detailed Circuit Description

The circuitry shown in block diagram form in FIGS. 6*a* and 6*b* will now be explained in greater detail.

Figure 7A:
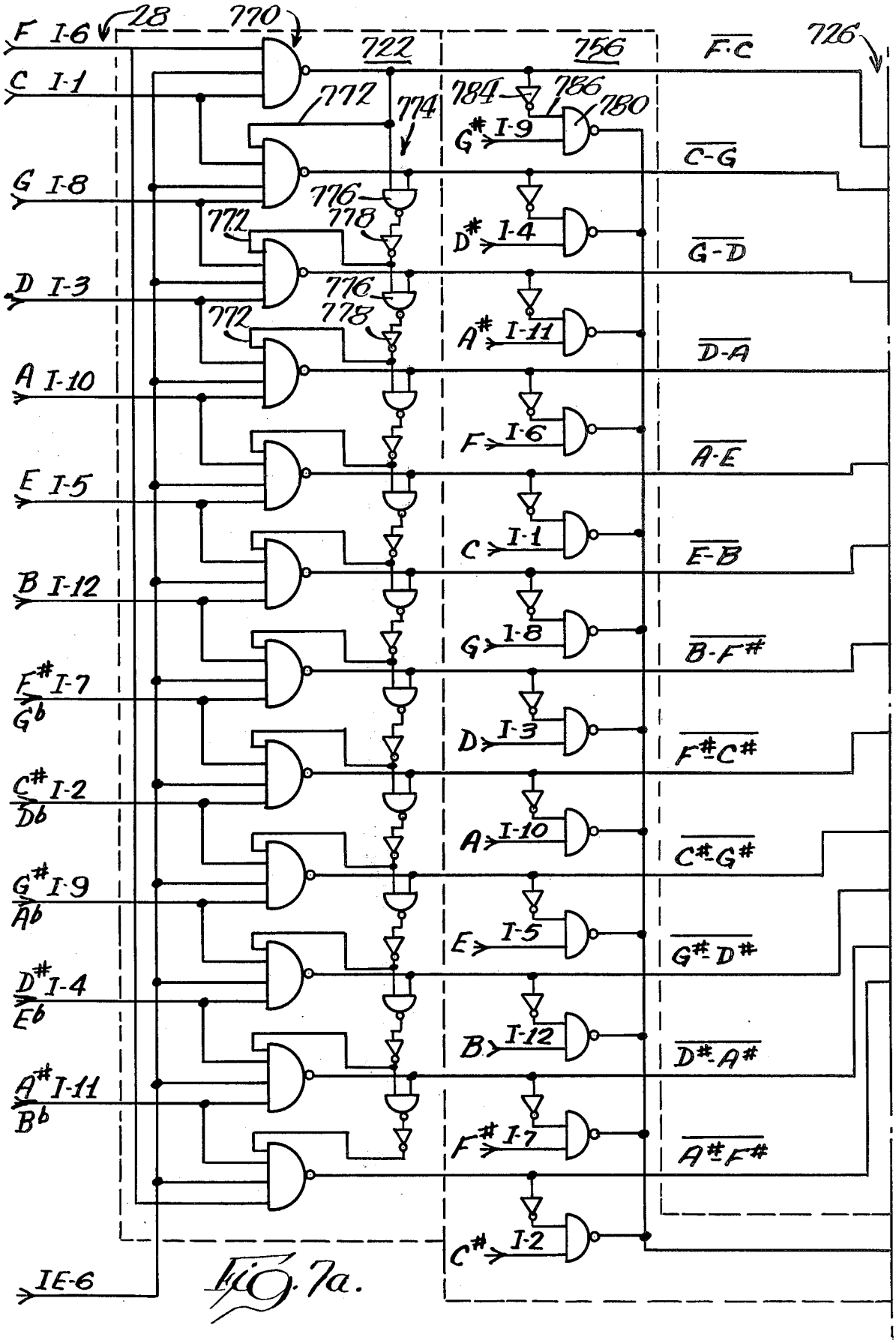

Referring to FIG. 7*a*, the twelve outputs 726 of fifths detection circuit 722 are seen to be taken from the respective outputs of twelve NAND gates 770. Each of the NAND gates 770 has a pair of note inputs connected with a pair of the encoding logic inputs 28 associated with the root-fifth pair detected thereby. For example, the first NAND gate 770 has a pair of note inputs F and C respectively connected to encoding logic inputs I-6 and I-1.

Each of NAND gates 770 also has a third input connected with input multiplex enable generator output IE-6. Only during the sixth enable period, when a 1-state signal is provided on output IE-6, are NAND gates 770 enabled to generate 0-state detection signals on their respective outputs in response to 1-state signals at their note inputs. Those NAND gates 770 which do have 1-state signals on both note inputs during the sixth enable period generate a 0-state detection signal on their outputs in response thereto. For example, if notes F and C are selected, and thus 1-state signals provided on outputs F and C to the first NAND gate 770, a 0-state detection signal is generated on output $\overline{FC}$ during the sixth input enable period.

The NAND gate having output $\overline{FC}$ is the NAND gate associated with the root-fifth pair of highest priority and has only three inputs. Each of the remaining NAND gates 770 has a fourth input 772 taken from a priority circuit 774. The priority circuit 774 is a priority chain of eleven link circuits. The first link circuit comprises the connection of output $\overline{FC}$ to the input 772 of the next lowest NAND gate 770. Each of the remaining ten link circuits is identical and comprises a NAND gate 776 and an inverter 778. Through action of the priority chain circuit, generation of a 0-state detection signal on any of the fifth detection circuit outputs 726 causes the link circuit having its input connected therewith to apply a 0-state disabling signal to the fourth input 772 of the NAND gate 770 connected with its output. The 0-state disabling signal from each link circuit also causes the next link circuit connected to its output to generate a 0-state disabling signal on its output, and so on through the chain. Thus, a 0-state detection signal can be generated on only one of outputs 726 at a time even though more than one root-fifth pair is selected. For example, if notes C, G and D are selected, a 0-state detection signal is generated on output $\overline{CG}$ but the NAND gate 770 connected with inputs G and D is disabled and provides a 1-state signal on its output $\overline{GD}$.

Figure 7B:
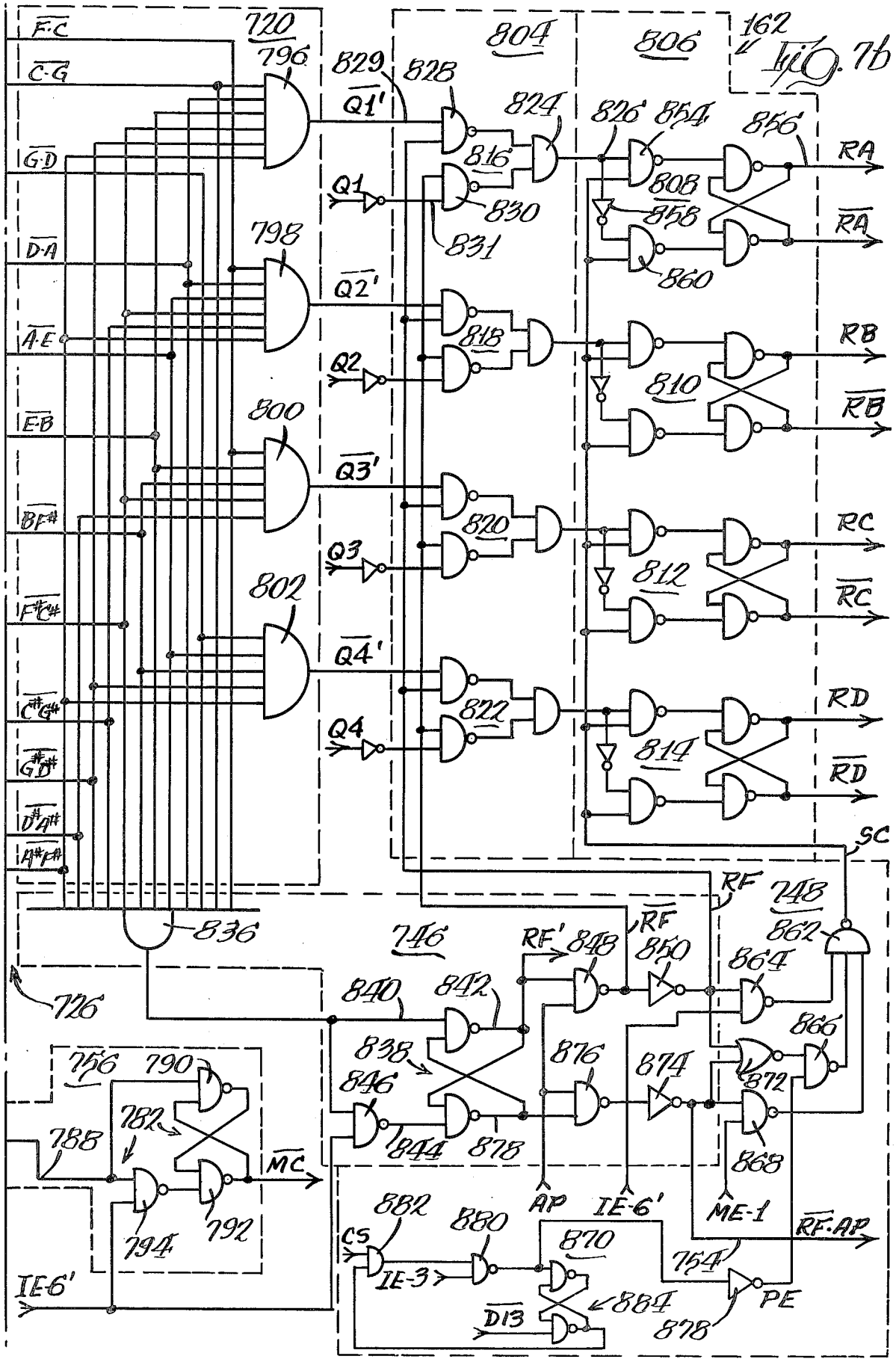

The minor chord detector circuit 756 is seen to include twelve NAND gates 780 (FIG. 7*a*) and a latch 782 (FIG. 7*b*). The twelve NAND gates 780 are respectively associated with the twelve NAND gates 770 of detection circuit 722. Each NAND gate 780 has a root input 786 connected through an inverter 784 with the output of its associated NAND gate 770. The other input of each NAND gate 780 is connected with the encoding logic input 28 that carries the note signal which is the flatted third of the root note at its root input 786. For example, the NAND gate 780 associated with the root-fifth pair F and C has its other input connected to encoding logic input I-9, which is the G♯ input to the fifth detection circuit 722. G♯ is, of course, the flatted third of the root note F. Thus, whenever three notes are selected, two of which are a valid root-fifth pair and the third of which is the flatted third of the root, a 0-state signal is generated on the output of one of NAND gates 780.

The outputs of all NAND gates 780 are connected to a control input 788 of latch 782. Latch 782 includes a set NAND gate 790, a reset NAND gate 792 connected in customary latching configuration with NAND gate 790, and a control NAND gate 794. Control NAND gate 794 has its output connected with the reset input of NAND gate 792. Control input 788 is connected with one input of NAND gate 794 and is connected also with the set input of NAND gate 790. The other input of NAND gate 794 is taken from function enable circuit output IE-6'.

If a minor chord is detected, the 0-state signal of input 788 of NAND gate 790 sets the latch with a 0-state signal being provided on output $\overline{MC}$. The latch remains in a set condition so long as a minor chord is being detected. When no minor chord is detected, the 1-state signal provided on input 788 enables control NAND gate 794. When enabled, NAND gate 794 generates a 0-state reset signal in response to generation of a 1-state signal on function enable circuit output IE-6'. The reset signal resets latch 782, thereby providing a 1-state signal on output $\overline{MC}$.

Still referring to FIG. 7*b*, the root encoder outputs $\overline{Q1'}$–$\overline{Q4'}$ are respectively taken from four AND gates 796, 798, 800 and 802. Each of detection circuit outputs 726 is connected with appropriate ones of NAND gates 796–802 so that the code generated thereby in response to a 0-state root detection signal is the inverse of the code for the root note. For example, output $\overline{D\text{-}A}$ is connected with an input of each of AND gates 796 and 798 and thus when a 0-state detection signal is generated thereon, 0-state signals are provided on outputs $\overline{Q1'}$ and $\overline{Q2'}$. The binary code is thus 1100. This is the inverse of the binary three code 0011, which is the code for the root note D. The corresponding root notes for the other fifth detection circuit outputs 726 are encoded in like fashion.

The pedal note latch circuit 162 includes a code selector 804 and a code latch 806. Code latch circuit 806 comprises four 1-bit latches 808, 810, 812 and 814 which respectively provide root code outputs RA, RB, RC and RD and the inverse outputs thereof. Latches 808–814 are respectively associated with four identical bit selectors 816, 818, 820 and 822. Each of bit selectors 816–822 has an AND gate 824 and two NAND gates 828 and 830 connected therewith. The output of each AND gate 824 is connected with a set input 826 of the associated bit latch. Two inputs of AND gate 824 are respectively connected with the outputs of a NAND gate 828 and NAND gate 830. The four NAND gates 828 have informational inputs 829 respectively connected with the $\overline{Q1'}$–$\overline{Q4'}$ outputs of root encoder circuit 720. The four NAND gates 830 have informational inputs 831 respectively connected through inverters 832 to outputs Q1–Q4 of code generator 138, FIG. 3*a*.

All NAND gates 828 also have another input connected with the RF output of code selection control circuit 746, and all NAND gates 830 have an input connected with the $\overline{RF}$ output. When RF is in a 1-state, $\overline{RF}$ is in a 0-state, and vice versa. Thus, when RF is in a 1-state, indicating detection of a valid root-fifth, the codes provided on the respective outputs of AND gate 824 are selected from the root encoder. When a 1-state signal is provided on $\overline{RF}$, indicating either nondetection of a valid root-fifth or nonselection of the auto pedal function, the codes selected for storage by code latch 806 are the codes provided on the code generator outputs Q1–Q4.

The logic states of the signals on $\overline{RF}$ and RF of code selection circuit 746 are determined by the logic states of function latch output AP and whether a root detection signal is generated by fifths detection circuit 722. Detection is achieved by an AND gate circuit 836 having twelve inputs respectively connected with the twelve fifths detection circuit outputs 726. If all outputs 726 are in a 1-state, AND gate 836 provides a 1-state signal on its output to indicate nondetection of a valid root-fifth. If a 0-state signal is generated on any of outputs 726, on the other hand, a 0-state signal is provided on the output of AND gate 836 to indicate detection of a valid root-fifth.

A NAND gate latch 838 has its set input 840 connected with the output of AND gate 836 and is latched into a set condition with a 1-state signal on its output RF' in response to a 0-state root-fifth detection signal from AND gate 836. The reset input 844 of latch 838 is connected to the output of a NAND gate 846 having one input connected with the output of AND gate 836 and another input connected with function enable circuit IE-6'. NAND gate 846 functions to generate a 0-state reset signal on its output to reset latch 838 in response to a 1-state signal on output IE-6', if the output of AND gate 836 reverts to a 1-state.

The set output RF' is connected to one of two inputs of a NAND gate 848, the output of which is the $\overline{RF}$ output. An inverter 850 driven by output $\overline{RF}$ provides output RF, and thus the outputs of RF and $\overline{RF}$ are always in opposite states.

The other input of NAND gate 848 is connected with function latch output AP. A 0-state signal at this input disables NAND gate 848 from responding to 1-state signals from latch 838. When disabled, NAND gate 848 provides a 0-state signal on its output $\overline{RF}$. Thus, when the auto pedal function is not selected, the codes provided by code generator 138 (FIG. 3*a*) are selected for storage.

In the auto pedal mode, with a 1-state signal on function latch output AP, NAND gate 848 is enabled to respond to the output of latch 838. The codes are selected from code generator 138 or the root encoder 720 (FIG. 6*a*) depending upon whether a valid root-fifth pair is detected. If a valid root-fifth pair is detected, a 1-state signal on RF causes the codes to be selected from the root encoder. If not, the code generator 138 codes are selected.

The code from the selected code source is entered into latches 808–814 in response to a 1-state signal generated on storage control circuit output SC. The set input 826 of each bit latch 808–814 is connected to a set NAND gate 854. Each set NAND gate 854 has another input connected with storage control circuit output SC. When a 1-state signal is provided on output SC, those bit latches having a 1-state signal at their set input 826 are switched to a set state in which a 1-state signal is provided on their normal output 856. Each bit latch having a 0-state signal at its set input 826 when the 1-state signal is generated on output SC is reset through action of an inverter 858 and a reset NAND gate 860.

Output SC is taken from a NAND gate 862 having three inputs respectively connected with the outputs of three other NAND gates 864, 866 and 868. When in the non-auto pedal mode, generation of the storage control signals is controlled by signals from NAND gate 866. The code for the note selected on the pedal clavier by the organist is entered during the third input enable period. When in the auto pedal mode and no valid root-fifth pair is detected, generation of the storage control signal is in response to signals developed by NAND gate 868. The code for the lowest note selected on the keyboard is entered from the code generator during the first and second input enable periods. If a valid root-fifth pair is detected when in the auto pedal mode, storage control signals are generated in response to signals developed by NAND gate 864. The root code from root encoder 720 is entered during the sixth input enable period.

NAND gate 864 has one input connected to the RF output of code selection circuit 746 and another input connected with function enable circuit output IE-6'. Thus, when a valid root-fifth pair is detected during the sixth input enable period, a 0-state signal is generated on the output of NAND gate 864. This results in a 1-state signal on output SC.

When enabled, generation of 0-state signals by NAND gate 866 is controlled by a circuit 870 having a pedal enable output PE connected therewith. NAND gate 866 is enabled by signals taken from the output of a NOR gate 872. NOR gate 872 has one input connected to the RF output and another input connected with the output of a second inverter 874. The input of inverter 874 is connected to the output of a NAND gate 876, which has one input connected with auto function latch output AP and another input connected to the reset output 878 of latch 838. Thus, when AP is in a 0-state, 0-state signals are applied to both inputs of NOR gate 872 which, in response thereto, provides a 1-state signal to the associated input of NAND gate 866. NAND gate 866 is thus enabled to respond to signals on output PE. The 0-state signals on the outputs of inverters 850 and 874 respectively disable NAND gates 864 and 868, and thus 0-state signals can be provided to the input of NAND gate 862 only by NAND gate 866.

A 0-state signal is generated on output PE and thus a 1-state signal is generated on storage control circuit output SC in response to the first code select pulse during the third input enable period. Output PE is taken from an inverter 878 which inverts the output signal from a NAND gate 880. NAND gate 880 has one input connected to input multiplex generator output IE-3 and another input connected to the output of an AND gate 882. AND gate 882, in turn, has one input connected to the encoding logic output CS, and another input connected to the reset outputs of a latch 884. Latch 884 has its reset input connected with encoding logic output $\overline{D13}$ so that at the beginning of each third input enable period, AND gate 882 is enabled to respond to a 1-state code select pulse on output CS. The 1-state signal on output IE-3 during the third input enable period enables NAND gate 880 to respond to a 1-state signal from AND gate 882. Likewise, NAND gate 880 is enabled to respond to 1-state signals from AND gate 882.

When the first code select pulse is generated during the third input enable period, a 0-state signal is generated on the output of NAND gate 880, inverted by inverter 878, and applied to NAND gate 866. NAND gate 866, in response thereto, provides a 0-state signal to NAND gate 862 and a 1-state signal is generated on output SC. The output of NAND gate 880 is also connected to the set input of latch 884. Thus, the 0-state signal generated on the output of NAND gate 880 in response to the first code select pulse causes the latch to switch to its set condition to disable AND gate 882 from responding to any further code select pulses generated during the third input enable period. On the $\overline{D13}$ pulse, latch 884 is reset so that AND gate 882 is again enabled to respond to code select pulses during the next third input enable period.

When the auto pedal function has been selected, the signals provided to NOR gate 872 from inverters 850 and 874 are always in opposite states. Thus, NAND gate 866 and NAND gate 862 are disabled from responding to pedal note code select pulses. Rather, entry of the selected code is controlled by the state of the signal on output RF. If a 1-state signal is provided on output RF, NAND gate 864 is enabled to respond to the 1-state enable signal applied to its one input from function enable circuit output IE-6' to generate a 0-state signal. NAND gate 862, in response thereto, generates a 1-state storage control pulse on its output and a root code from encoder 720 is entered into the latch 806. If a 0-state signal is provided on output RF, NAND gate 864 is disabled, and a 1-state signal on the output of inverter 874 enables NAND gate 868 to respond to the memory enable pulse on output ME-1 from keynote memory control circuit 164, FIG. 3c. A 1-state memory enable pulse is generated on output ME-1 in response to first code select pulse occurring during either the first or second input enable period, and thus the note code entered into pedal note latch circuit 162 is the same code entered into the keynote latch circuit 154, FIG. 3c. This code is the code for the lowest selected note on the keyboard.

Turning now to FIG. 8, the circuitry corresponding to interval signal decoder 750 will be described. Circuit 750 has four information receiving NAND gates 888, 890, 892, and 894. Each of the NAND gates has one input connected to an output CE-P of a note multiplex enable generator 64 and is enabled to respond to a 1-state signal at an informational input thereof only when a 1-state enable signal is provided on output 896.

Thus, NAND gates 888–894 are enabled only when a note code is being read out of pedal note latch 162.

The informational inputs of NAND gates 888–892 are respectively connected to function latch outputs A, B and C. A second enable input to each NAND gate 888–892 is connected with function latch output WB. Thus, the interval decoder 750 is enabled to decode interval signals on function latch outputs A–C only when the walking bass function has been selected.

NAND gate 894 has two additional enable inputs and an informational input connected with function latch output FIFTH. The two enable inputs are respectively connected to an output WB from an inverter 906 providing the inverse of the signal from function latch output $\overline{WB}$. The other enable input is connected to the fancy foot function latch output $FF_0$. Only when the walking bass function has not been selected and the fancy foot function has been selected is NAND gate 894 enabled to respond to a 1-state signal from function latch output FIFTH.

The output FIFTH is taken from an inverter 914. Outputs $\overline{3rd}$ and $\overline{\flat 3rd}$ are respectively taken from NAND gates 908 and 910, which each have an information input connected with the output of an inverter 922. Inverter 922 provides a 1-state signal to NAND gates 908 and 910 when the code generated on outputs A, B and C is decoded by a NAND gate 921 connected therewith. NAND gate 908 also has an input connected with the $\overline{MC}$ output of minor chord detector 756. NAND gate 910 has an input connected to output $\overline{MC}$ through an inverter 924. When a minor chord has been detected, a 0-state signal is generated on the output of NAND gate 910 in response to a 1-state signal from inverter 922. When a minor chord is not detected, the 0-state signal is generated on the output of NAND gate 908.

A 0-state detection signal is generated on output 5th in response to the code therefor at inputs A, B and C when the walking bass function has been selected through action of a NAND gate 926 and a NAND gate 928. NAND gate 928 is connected with appropriate ones of the outputs of NAND gates 888–892 and the outputs of inverters 930, 932 and 934 respectively connected therewith to decode the binary three code of the fifth interval. When logic states of 0, 1 and 1 are respectively provided on outputs C, B and A, all of the inputs to NAND gate 928 are in a 1-state, and a 0-state signal is generated on the outputs thereof. NAND gate 926, in response to a 0-state signal, provides a 1-state signal to inverter 914 which, in turn, provides a 0-state interval signal on its output 5th.

When the walking bass function has not been selected, NAND gates 888–892 are disabled from providing on their outputs the code for the 5th interval, and thus the output of NAND gate 928 is in a 1-state. NAND gate 926 is then enabled to respond to the output of NAND gate 894. If a 1-state signal is provided on the 5th and $FF_0$ inputs to NAND gate 894, a 0-state signal is applied to the input of NAND gate 926. NAND gate 926, in response thereto, provides a 1-state signal to inverter 914, which in turn generates a 0-state interval signal on its output 5th. If, on the other hand, either or both of the 5th and $FF_0$ inputs to NAND gate 894 is in a 0-state, a 1-state signal is provided on output 5th and no interval is indicated.

The remaining outputs 4th, 6th, 7th and 8th are respectively taken from the outputs of four NAND gates 912, 916, 918 and 920. NAND gates 912–920 are connected with the appropriate ones of NAND gates 888–892 and inverters 930–934 to decode binary counts of six, four, seven and five, respectively, and operate in an identical fashion as NAND gate 928.

Still referring to FIG. 8, half step number encoder 760 is seen to comprise four NAND gates 930, 932, 934 and 936 and four NAND gates 900, 902, 904 and 906 for respectively providing the half step number signals on outputs HA-HD. Outputs $\overline{HA}$-$\overline{HD}$ are taken from the outputs of the four inverters 938 respectively connected with the outputs of NAND gates 930–936. The interval signal decoder outputs 764 are connected with appropriate ones of NAND gates 930–936 to result in generation of the binary number representative of the number of half steps associated therewith. For example, output 4th is connected with an input of each of NAND gates 934 and 930. Thus, when a 0-state interval signal is generated on output $\overline{4th}$, 1-state signals are provided on outputs HC and HA by NAND gates 934 and 930, respectively, and 0-state signals are provided on outputs HB and HD. Thus, the five half steps associated with the 4th interval is represented as a binary five by logic state signals of 0101 on outputs HD-HA, respectively. The codes for the other interval signals are generated in like fashion.

Octave decoder 762 provides its OCT output from a NAND gate 940 in response to signals taken from the outputs of a NAND gate 942 and a NAND gate 944. NAND gate 942 has two inputs respectively connected with the inverse output of the auto pedal function latch and the PL/H output of the function latch. When not in the auto pedal mode, the code entered into pedal note latch circuit 162 is taken from the pedal clavier selection, and NAND gate 942 is enabled by output $\overline{AP}$ to respond to the organist's selection of the pedal low/-high function. With a 1-state signal on output PL/H, a 0-state signal is generated on the output of NAND gate 942 and NAND gate 940, in response thereto, generates a 1-state signal on its output OCT. With output PL/H in a 0-state, a 1-state signal is generated by NAND gate 942, and a 0-state signal is provided on the output OCT.

When in the auto pedal mode, NAND gate 944 is enabled to provide 0-state input signals to NAND gate 940 if a valid root-fifth pair is not detected. Enablement of NAND gate 944 is achieved in response to this condition by the application of a 1-state signal to an input thereof connected with output 754. The other input of NAND gate 944 is taken from the output of a NAND gate 946 which has four inputs respectively connected with the $\overline{5th}$, $\overline{6th}$, $\overline{7th}$ and $\overline{8th}$ interval signal decoder outputs. Whenever 0-state interval signals are provided on these outputs, NAND gate 946 switches to a 0-state, which causes NAND gate 944 to switch to a 1-state. NAND gate 940, in response thereto, generates a 0-state signal on its output OCT.

At the same time, when in the auto pedal mode and when no valid root-fifth pair is detected the 1-state signal on output 754 causes NOR gate 896 to disable all of the outputs of half step encoder 760 by providing a 0-state signal to the inputs of NAND gates 900–906. Similarly if the rhythm unit is off an $\overline{RY}$ output to NOR gate 896 disables NAND gates 900–906. Thus in the auto pedal mode when no valid root-fifth pair is detected the low note held on the manual is sounded on the root, 3rd and 4th interval counts and the low note held on the manual in the next higher octave is played on the 5th, 6th, 7th and 8th interval counts.

The circuitry corresponding to adder 706 is shown in FIG. 9. As seen, adder 714 includes nine exclusive OR gate circuits 950, 952, 954, 956, 958, 960, 962, 964 and 966 connected to form four adder stages 968, 970, 972 and 974, respectively associated with outputs P1–P4. Each of the exclusive OR gates is substantially identical, having four inputs 980, 982, 984 and 986 and an output 976 taken from a NAND gate 978. Inputs 980 and 982 are connected to a NAND gate 988 having its output applied to one input of NAND gate 978. Inputs 984 and 986 are respectively connected to two inputs of a NAND gate 990 which has its output connected to another input of NAND gate 978. Inputs 982 and 984 are inverted inputs and inputs 980 and 986 are normal inputs.

When signals having logic states of zero and one, or one and zero, are respectively provided to the normal inputs, a 1-state signal is generated on output 976. When signals having logic states of one and one, or zero and zero are respectively provided to the normal inputs, a 0-state signal is generated on output 976.

Referring to exclusive OR gate circuit 950, for example, it is seen that the inverted inputs 982 and 984 are respectively connected to inverted half step number adder and root encoder outputs $\overline{HA}$ and $\overline{RA}$. Normal inputs 980 and 986 are respectively connected to outputs RA and HA. Thus, when the logic state of the least significant bit of the half step number and the root code number are both zeros, or both ones, a 0-state signal is provided on output 976 which is note code bit output P1. When one of outputs RA and HA is in a 0-state, and the other is in a 1-state, a binary one is provided on output P1.

If both RA and HA are in a 1-state, a logical one must be carried to the next most significant bit location, which is the bit location associated with output P2 of stage 970. The logic-1 is carried to exclusive OR gate 958 of stage 970 by a NOR gate 992. NOR gate 992 has one input connected with $\overline{RA}$ and the other input connected with $\overline{HA}$. Thus, when both RA and HA are in logic-1 states, a 0-state signal is provided on the output 994 of NOR gate 992. This signal is applied to normal input 980 of exclusive OR gate circuit 958 and applied also to the inverted input 984 thereof through an inverter 996. The inverted input 982 is connected through an inverter 998 to the output 976 of exclusive OR gate 952 and normal input 986 is connected directly to output 976 of exclusive OR gate circuit 952.

Exclusive OR gate circuit 952 is connected with half step number encoder outputs HB and $\overline{HB}$ and root encoder outputs RB and $\overline{RB}$, in an analogous fashion as exclusive OR gate 950, and provide a carry signal on the output of its carry NOR gate 1000. Exclusive OR gate 958 also has a carry NOR gate 996. The outputs of carry NOR gates 1000 and 996 are respectively connected to two inputs of a NOR gate 1002. The output of NOR gate 1002 is connected through an inverter 1004 and applied to inputs 980 and 984 of exclusive OR gate 960. Thus, if a carry signal is provided from either of carry NOR gates 996 or 1000, a carry signal is applied to exclusive OR gate 960.

In like fashion, exclusive OR gates 954 and 956 are connected with outputs RC and $\overline{RC}$ and HC and $\overline{HC}$, and outputs $\overline{RD}$, HD and $\overline{HD}$, respectively, and provide carry signals on carry NOR gates associated therewith to carry circuits 1005 and 1007 of exclusive OR gates 960 and 962. Likewise, exclusive OR gates 954 and 956 provide output signals to the inputs 982 and 986 of exclusive OR gates 960 and 962, respectively.

The outputs of exclusive OR gates 960 and 962 are respectively connected to inputs 982 and 986 of exclusive OR gates 964 and 966, respectively. A carry signal is provided to exclusive OR gate 966 from exclusive OR gate 964 through a carry NOR gate 1008 and a carry signal is provided to inputs 982 and 986 of exclusive OR gate 964 through circuitry including a NAND gate 1010, a NAND gate 1012, an inverter 1014 and a NOR gate 1016.

When the sum of the two numbers from the root encoder and half step number encoder is twelve, 0-state signals are respectively provided on outputs P1 and P2 and thus to the two inputs of NOR gate 1016. NOR gate 1016, in response thereto, provides a 1-state signal on its output which is inverted by inverter 1014 to a 0-state signal. This 0-state signal is applied to an input 1018 of NAND gate 1012. NAND gate 1012, in response thereto, provides a 1-state signal to NAND gate 1010. The other input to NAND gate 1010 is taken from the carry circuit of exclusive OR gate 962 and is also in a 1-state and thus output P5 from NAND gate 1010 is in a 0-state. In this condition, 1-state signals are provided on outputs P3 and P4 of exclusive OR gates 964 and 966, respectively.

When the input codes are changed so that the total would be a count of thirteen, a 1-state signal is provided on output P1. NOR gate 1016, in response thereto, switches to a 0-state and inverter 1014 switches to a 1-state. This enables NAND gate 1018 to respond to 1-state signals provided on outputs 976 of exclusive OR gates 960 and 962 to generate a 0-state signal. The 0-state signal on the output of NAND gate 1012 causes NAND gate 1010 to switch to a 1-state, thus providing a 1-state signal on output P5. The 1-state signal on the output of NAND gate 1010 is also applied to the input of exclusive OR gate 964 and causes it to switch its output P3 to a 0-state. Exclusive OR gate circuit 964 also provides a 1-state carry signal on the output of carry NOR gate 1008 to exclusive OR gate circuit 966. Exclusive OR circuit 966, in response thereto and to the 1-state signal from the output of exclusive OR gate circuit 962, provides a 0-state signal on output P4.

Having described the invention, the embodiments of the invention in which an exclusive property or privilege is claimed are defined as follows:

1. In an electrical musical instrument having means for generating tone signals corresponding to note codes applied thereto, the improvement comprising:

note means for developing a note code representative of a number value corresponding to a selected note;

interval means for developing an interval code representative of a number value corresponding to the distance between notes with the number value increasing as an arithmetic progression over a range of notes as the distance between notes increases; and an adder for arithmetically adding the number values of the note code and the interval code to generate a new number value corresponding to a new note code for a new note which is spaced from the selected note by the distance between the notes.

2. The electrical musical instrument of claim 1 wherein the interval means develops an interval code having a fixed number value each time the new note is to be spaced from the selected note by the same interval.

3. The electrical musical instrument of claim 1 wherein the number values of the note code and the interval code are represented by binary numbers having a plurality of bit locations which in sum represent the number value.

4. The electrical musical instrument of claim 3 wherein some of the plurality of bit locations represent a number value corresponding to a note location within an octave, and at least another of the plurality of bit locations represents a number value corresponding to an octave within which the note is located.

5. The electrical musical instrument of claim 1 wherein the adder comprises a modulo 12 adder which generates a five-bit code with the fifth most significant bit having a number value of 12 to thereby correspond to a different octave, and the tone signal generating means includes an octave circuit responsive to the fifth bit for selecting the octave for the selected note.

6. The electrical musical instrument of claim 1 wherein the interval code has a number value corresponding to the number of half steps between two notes so that consecutive number values represent adjacent notes on a twelve note scale.

7. The electrical musical instrument of claim 1 wherein the interval means includes an interval signal encoder having a plurality of output lines carrying fixed interval signals thereon which are respectively associated with different ones of the interval lines to represent different fixed intervals, and a half step encoder responsive to the plurality of output lines for generating the interval code representative of the number of half steps in the interval associated with the selected output.

8. The electrical musical instrument of claim 7 wherein said note means includes means for detecting the selection of a plurality of notes comprising a minor chord, said minor chord detecting means being connected to the interval means for selectively providing an interval signal on one of two outputs thereof respectively associated with the third interval and the flatted third interval.

9. The electrical musical instrument of claim 8 wherein the interval means includes first means for generating an interval signal on a third interval output in response to a particular input signal, second means for generating an interval signal on a flatted third interval output in response to the same particular input signal, and means responsive to detection of a minor chord for disabling the first means.

10. The electrical musical instrument of claim 7 wherein said interval means is responsive to signals on two sets of inputs to generate the interval code, and means manually operable for effectively disabling one of the sets of inputs to disable response to signals thereon.

11. The electrical musical instrument of claim 1 including a first note selection means for selecting notes and a separate second note selection means for selecting notes, the note means includes storage means for storing the note code, and means responsive to establishment of one mode of operation for entering into the storage means note codes representing notes selected on the first note selection means and responsive to another mode of operation for entering into the storage means note codes representing notes selected on the second note selection means.

12. The electrical musical instrument of claim 11 wherein said first note selection means corresponds to a manually actuable keyboard manual and the second note selection means corresponds to a manually actuable pedal clavier.

13. The electrical musical instrument of claim 1 wherein the interval means generates an interval code representative of a chordal interval to cause the new note code from the adder to have a preselected chordal relationship to a selected note, and means for applying both the new note code and the selected note code to the tone signal generating means, whereby plural tone signals corresponding to both the selected note and the chordally related note are simultaneously generated thereby.

14. In an electrical musical instrument having input means for selecting notes and means for generating tone signals in accordance with note codes corresponding to the selected notes, the improvement comprising:

a detector for detecting when two selected notes are related to one another as a pair comprising a root and a fixed interval therefrom, note means responsive to the detector for producing a note code representative of the selected pair of notes, interval means for developing an integral code representative of an interval between two notes, and an adder for arithmetically adding the note code and the interval code to generate a new note code for a note which is spaced from one of the selected pair of notes by the interval.

15. The electrical musical instrument of claim 14 wherein the detector detects when the two selected notes are related to one another as a pair comprising a root and a fifth interval.

16. The electrical musical instrument of claim 15 wherein the detector includes a priority circuit for establishing an order of priority for the twelve root-fifth pairs of notes around the circle of fifths, said priority circuit includes means responsive to detection of two root-fifth pairs for preventing the note means for producing a note code for the selected lowest priority root-fifth pair.

17. The electrical musical instrument of claim 16 wherein said detector has twelve outputs respectively associated with the twelve root-fifth pairs of the circle of fifths, means responsive to a selected one of the twelve outputs for generating a code associated therewith, and said preventing means includes means for preventing generation of an output on more than one of the twelve outputs at a time.

18. The electrical musical instrument of claim 14 wherein the note means in response to the detector develops a note code representative of the root note.

19. The electrical musical instrument of claim 14 wherein the note means includes storage means for storing the note code.

20. A method for generating notes in an electrical musical instrument, comprising the steps of: selecting a root note, developing a first number value representative of the root note, selecting a musical chord interval representing a fixed spacing between notes of a twelve note scale, developing a second number value representative of the chord interval, adding the first and second number values to produce a third number value equal to the sum thereof, and assigning a note to said third number value.

21. The method of claim 20 wherein each of the number values are represented by binary codes equal to the number value.

* * * * *